US008774650B2

(12) United States Patent
Okoshi

(10) Patent No.: US 8,774,650 B2
(45) Date of Patent: Jul. 8, 2014

(54) ROTARY DEVELOPING DEVICE AND IMAGE FORMING APPARATUS

(75) Inventor: Takeshi Okoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 530 days.

(21) Appl. No.: 13/114,753

(22) Filed: May 24, 2011

(65) Prior Publication Data

US 2012/0114381 A1 May 10, 2012

(30) Foreign Application Priority Data

Nov. 10, 2010 (JP) ..... 2010-252368

(51) Int. Cl.
*G03G 15/00* (2006.01)
*G03G 15/01* (2006.01)

(52) U.S. Cl.
USPC ..... 399/37; 399/88; 399/89; 399/90; 399/227

(58) Field of Classification Search
USPC ..... 399/37, 88–90, 227
See application file for complete search history.

(56) References Cited

U.S. PATENT DOCUMENTS 3,696,783 A * 10/1972 Fantuzzo ..... 399/279

FOREIGN PATENT DOCUMENTS

| | | | | |
|---|---|---|---|---|
| JP | 62015565 A | * | 1/1987 | ..... G03G 15/00 |
| JP | 4-78872 A | | 3/1992 | |
| JP | 3303607 B2 | | 12/1996 | |
| JP | 2000-131942 A | | 5/2000 | |
| JP | 2000-231250 A | | 8/2000 | |
| JP | 2000-321858 A | | 11/2000 | |
| JP | 2001-122414 A | | 5/2001 | |
| JP | 2001-134045 A | | 5/2001 | |

* cited by examiner

*Primary Examiner* — David Gray
*Assistant Examiner* — Andrew Do
(74) *Attorney, Agent, or Firm* — Sughrue Mion, PLLC

(57) ABSTRACT

A rotary developing device that rotates about a rotational axis includes plural developing units, an energized member, a hollow cylindrical unit, a first energizing member, a rotatable unit, a second energizing member, a first conductive member, and a second conductive member. Each developing unit develops a latent image formed on an image holding member into a visible image, and is rotatable about the rotational axis so as to be sequentially movable to a developing position facing the image holding member. The hollow cylindrical unit is arranged along the rotational axis. The rotatable unit is supported rotatably with respect to the hollow cylindrical unit. One end of the first conductive member is connected to the first energizing member supported on an outer periphery of the hollow cylindrical unit. The second conductive member connects the second energizing member supported by the rotatable unit to the energized member supported in a developing unit.

22 Claims, 14 Drawing Sheets

ROTARY DEVELOPING DEVICE AND IMAGE FORMING APPARATUS

CROSS-REFERENCE TO RELATED APPLICATIONS

This application is based on and claims priority under 35 USC 119 from Japanese Patent Application No. 2010-252368 filed Nov. 10, 2010.

BACKGROUND (i) Technical Field

The present invention relates to a rotary developing device and an image forming apparatus.

(ii) Related Art

Conventional image forming apparatuses include a revolver-type developing device, called a rotary developing device, having multiple developing units supported rotatably about a rotational axis so that the developing units are caused to sequentially face an image holding member to perform development.

SUMMARY

According to an aspect of the invention, there is provided a rotary developing device configured to rotate about a rotational axis. The rotary developing device includes plural developing units, an energized member, a hollow cylindrical unit, a first energizing member, a rotatable unit, a second energizing member, a first conductive member, and a second conductive member. Each of the plural developing units is configured to develop a latent image formed on a surface of an image holding member into a visible image, and is rotatable about the rotational axis so as to be sequentially movable to a developing position facing the image holding member. The energized member is supported in a developing unit among the developing units. The hollow cylindrical unit has a space therein. The hollow cylindrical unit is arranged along the rotational axis, and is fixed so that the rotatable unit rotates about the fixed hollow cylindrical unit. The first energizing member is supported on an outer periphery of the hollow cylindrical unit. The rotatable unit is supported rotatably with respect to the hollow cylindrical unit, and rotates together with the rotary developing device. The second energizing member is supported by the rotatable unit, and includes a contact portion that comes into contact with the first energizing member. The first conductive member has an end connected to the first energizing member, and another end lead out to outside the developing device through the space in the hollow cylindrical unit. The second conductive member connects the second energizing member to the energized member.

BRIEF DESCRIPTION OF THE DRAWINGS

Exemplary embodiment(s) of the present invention will be described in detail based on the following figures, wherein:

FIG. 6A is a cross-sectional view taken along line VIA-VIA of FIG. 5 and FIG. 6B is a cross-sectional view taken along line VIB-VIB of FIG. 6A;

FIG. 8A illustrates a state where a replenishing cylinder has been removed from the developing unit, FIG. 8B illustrates the arrangement of gears provided in a rearward end portion of the developing unit illustrated in FIG. 8A, and FIG. 8C illustrates a state where a replenishing cylinder is attached to the developing unit;

FIG. 10A is a cross-sectional view taken along line XA-XA of FIG. 5 and FIG. 10B is a cross-sectional view taken along line XB-XB of FIG. 5;

FIG. 14A is a cross-sectional view taken along line XIVA-XIVA of FIG. 13 and FIG. 14B is a cross-sectional view taken along line XIVB-XIVB of FIG. 13.

DETAILED DESCRIPTION

A specific example of an exemplary embodiment of the present invention (hereinafter referred to as an "exemplary embodiment") will be described hereinafter with reference to the drawings. It is to be understood that the present invention is not limited to the following exemplary embodiment.

For ease of understanding of the following description, in the figures, the back and forth direction is defined as an X-axis direction, the left and right direction as a Y-axis direction, and the up and down direction as a Z-axis direction. Also, directions or sides indicated by arrows X, −X, Y, −Y, Z, and −Z are defined as a forward direction, a rearward direction, a rightward direction, a leftward direction, an upward direction, and a downward direction, respectively, or a forward side, a rearward side, a right side, a left side, an upper side, and a lower side, respectively.

Further, in the figures, an arrow pointing from the back to the front of the paper is represented by a dot in a circle, and an arrow pointing from the front to the back of the paper is represented by a cross in a circle.

In the following description taken in conjunction with the drawings, for ease of understanding, illustration of members other than those necessary for the description is properly omitted.

First Exemplary Embodiment

Figure 1:
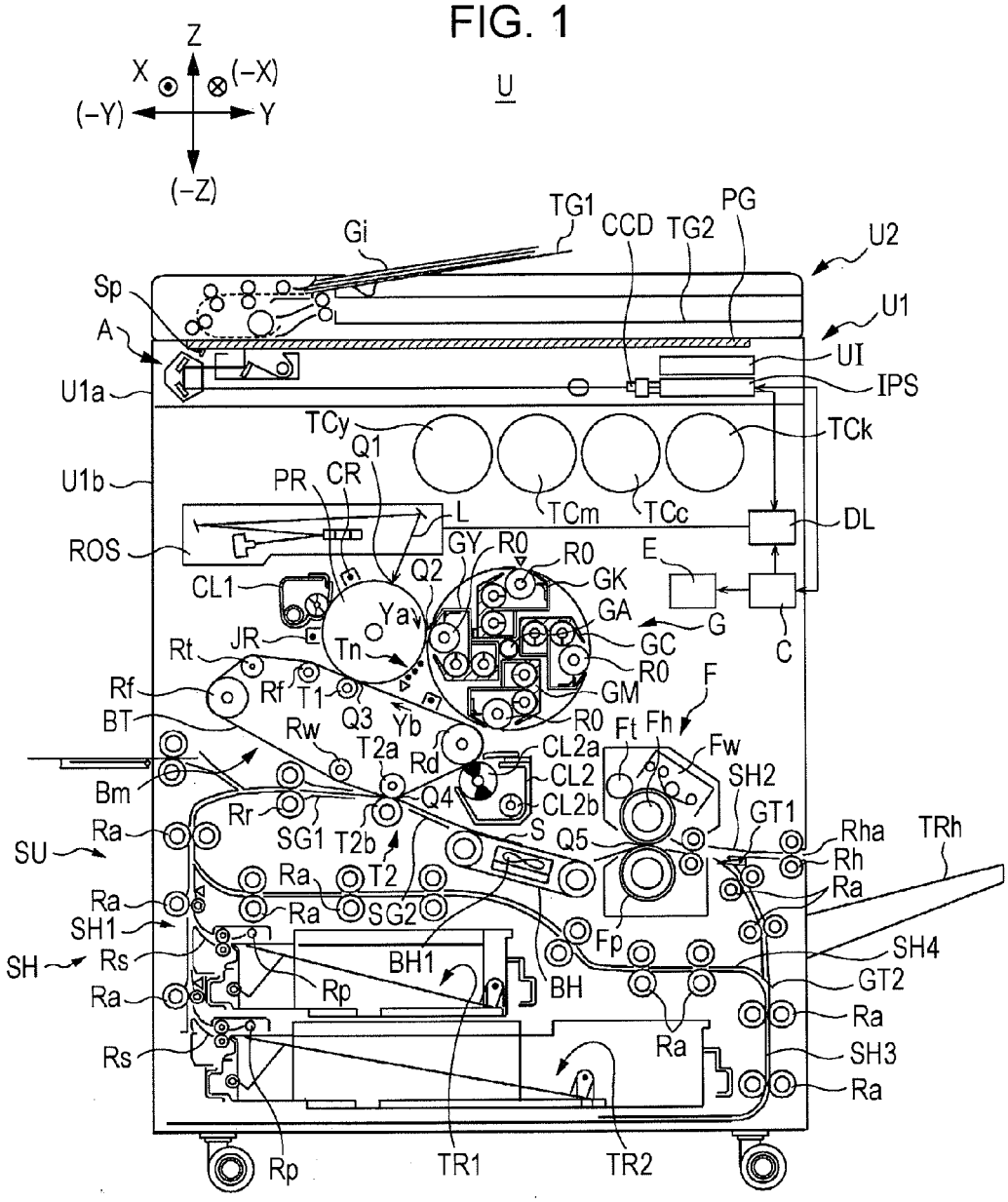
FIG. 1 illustrates an image forming apparatus according to a first exemplary embodiment of the present invention.

FIG. 1 illustrates an image forming apparatus according to a first exemplary embodiment of the present invention.

In FIG. 1, a copying machine U as an example of an image forming apparatus according to an exemplary embodiment of the present invention includes a main body U1 of the copying machine U (hereinafter referred to as the "copying machine body U1" and a document transport device U2 supported at an upper end of the copying machine body U1.

The document transport device U2 includes a document feed tray TG1 as an example of a document receiving unit in which plural documents G1 to be copied are stacked one upon another and are received. The plural documents G1 received in the document feed tray TG1 sequentially pass a copying position on a platen glass PG as an example of a transparent document table at the upper end of the copying machine body U1, and are discharged to a document discharge tray TG2 as an example of a document discharge unit. The document transport device U2 is rotatable relative to the copying machine body U1 about a rotational shaft that is provided at a rear end thereof and that extends in the left and right direction. When a user manually places a document G1 on the platen glass PG, the document transport device U2 rotationally moves in the upward direction.

The copying machine U includes an operation unit UI operated by a user to input an operation command signal such as a copy start signal.

The operation unit UI includes a display unit and an input unit such as a copy start button and a ten-key pad.

A scanner unit U1*a* as an example of an image reading unit is arranged below the transparent platen glass PG on the upper surface of the copying machine body U1, and a printer unit U1*b* as an example of an image recording unit is arranged below the scanner unit U1*a*. An exposure optical system A is supported inside the scanner unit U1*a* so as to be movable in the left and right direction.

The exposure optical system A is controlled to move and stop in accordance with a detection signal of an exposure system registration sensor Sp as an example of a position detection member. Under normal conditions, the exposure optical system A is maintained stationary at an initial position illustrated in FIG. 1, or the so-called home position.

Light reflected from a document G1 that passes an exposure position on the upper surface of the platen glass PG by using the document transport device U2 or light from a document manually placed on the platen glass PG passes through the exposure optical system A, and is converted into electrical signals of red (R), green (G), and blue (B) by using an imaging element CCD.

An image processing unit IPS converts the electrical signals of RGB input from the imaging element CCD into image data of black (K), yellow (Y), magenta (M), and cyan (C) and temporarily stores them. Then, at a preset time, the image processing unit IPS outputs the image data as image data for forming a latent image to a laser drive circuit DL as an example of a write drive circuit.

The laser drive circuit DL outputs a laser drive signal as an example of a write signal to a latent image forming device ROS in accordance with the input image data.

A photoconductor PR as an example of an image holding member is arranged below the latent image forming device ROS. The photoconductor PR is driven to rotate in a direction indicated by the arrow Ya. A surface of the photoconductor PR is charged uniformly by a charger CR, and is then exposed and scanned by a laser beam L as an example of a write beam of the latent image forming device ROS at a latent image write position Q1 to form an electrostatic latent image. In order to form a multi-color image called a color image, electrostatic latent images corresponding to images of four colors, black (K), yellow (Y), magenta (M), and cyan (C), are sequentially formed. In order to form a single-color image called a monochrome image, only an electrostatic latent image corresponding to an image of black (K) is formed.

The surface of the photoconductor PR on which the electrostatic latent image or images are formed rotationally moves and sequentially passes a developing area Q2 and a first-transfer area Q3.

A revolver-type or rotary developing device G is arranged rightward of the photoconductor PR. The developing device G includes developing units GK, GY, GM, and GC of four colors, black (K), yellow (Y), magenta (M), and cyan (C), which sequentially rotate and move to the developing area Q2 in accordance with the rotation of a rotational shaft GA. Each of the developing units GK, GY, GM, and GC of the respective colors has a developing roller R0 as an example of a developer holding member that transports the corresponding developer to the developing area Q2, and develops an electrostatic latent image formed on the photoconductor PR that passes the developing area Q2 into a toner image as an example of a visible image.

Each of the developing units GK, GY, GM, and GC is configured to be replenished with a new developer from a corresponding one of toner cartridges TCk, TCy, TCm, and TCc as an example of a developer accommodating containers in accordance with consumption of the corresponding developer.

An intermediate transfer belt BT as an example of an image holding member and also as an example of an intermediate transfer body is arranged below the photoconductor PR. The intermediate transfer belt BT is supported so as to be rotatable and movable by a belt drive roller Rd as an example of a driving member, a tension roller Rt as an example of a tension applying member, a walking roller Rw as an example of a member that prevents meandering of the intermediate transfer belt BT, idler rollers Rf as examples of a driven member, a backup roller T2*a* as an example of a second-transfer member facing member, and a first-transfer roller T1 as an example of a first-transfer member.

The rollers Rd, Rt, Rw, Rf, and T2*a* form a belt support roller Rd+Rt+Rw+Rf+T2*a* as an example of an intermediate transfer support member according to the first exemplary embodiment. Further, the intermediate transfer belt BT, the belt support roller Rd+Rt+Rw+Rf+T2*a*, the first-transfer roller T1, and any other suitable member form an intermediate transfer device BT+Rd+Rt+Rw+Rf+T2*a*+T1 according to the first exemplary embodiment.

In order to form a full-color image, an electrostatic latent image of a first color is formed at the latent image write position Q1, and a toner image Tn of the first color is formed in the developing area Q2. The formed toner image Tn is electrostatically first-transferred onto the intermediate transfer belt BT by the first-transfer roller T1 when passing the first-transfer area Q3. After that, similarly, toner images Tn of a second color, a third color, and a fourth color are first-transferred onto the intermediate transfer belt BT that carries the toner image Tn of the first color so as to be superimposed one on top of the other, and finally a full-color, multi-colored toner image is formed on the intermediate transfer belt BT.

In order to form a mono-color image of a single color, only one developing unit is used, and a mono-color toner image is first-transferred onto the intermediate transfer belt BT.

After the first-transfer process, residual toner on the surface of the photoconductor PR undergoes charge erasure by a charge eraser JR, and a residual developer is removed by a photoconductor cleaner CL1 as an example of a photoconductor cleaning unit.

A second-transfer roller T2*b* as an example of a second-transfer member is arranged below the backup roller T2*a* so as to be movable between a position out of contact with the backup roller T2*a* and a position in contact with the backup roller T2*a*. An area where the backup roller T2*a* and the second-transfer roller T2*b* are brought into contact with each other forms a second-transfer area Q4.

A second-transfer voltage of a polarity opposite to the polarity of the electric charge of toner used in the developing device G is supplied to the backup roller T2*a* from a power supply circuit E, and the power supply circuit E is controlled by a controller C as an example of a control unit.

The backup roller T2*a* and the second-transfer roller T2*b* form a second-transfer unit T2 according to the first exemplary embodiment. The intermediate transfer device BT+Rd+Rt+Rw+Rf+T2*a*+T1 and the second-transfer device T2 form a transfer device T1+T2+BT according to the first exemplary embodiment.

Paper feed trays TR1 and TR2 as examples of a medium receiving container are arranged in a lower portion of the copying machine body U1 so as to be removably supported. When a copying operation is started, recording sheets S as examples of a medium received in the paper discharge trays TR1 and TR2 are picked up by pickup rollers Rp as examples of an extraction member at a preset time. The recording sheets S picked up by the pickup rollers Rp are separated one by one by a sheet separation roller Rs as an example of a sheet separation member, and are transported by plural transport rollers Ra as examples of a transport member arranged along a paper feed path SH1 as an example of a medium transport path. A recording sheet S transported by the transport roller Ra is transported to a registration roller Rr as an example of a transfer supply time adjustment member. The recording sheet S transported to the registration roller Rr is transported to the second-transfer area Q4 through a pre-transfer sheet guide SG1 as an example of a pre-transfer guide member in time with the movement of the first-transferred multi-colored toner image or mono-color toner image to the second-transfer area Q4.

In the second-transfer area Q4, the second-transfer unit T2 electrostatically second-transfers the toner image on the intermediate transfer belt BT onto the recording sheet S. Residual toner on the intermediate transfer belt BT after the second-transfer process is removed by a belt cleaner CL2 as an example of an intermediate transfer cleaning unit, and the second-transfer roller T2*b* is cleaned by a second-transfer cleaner CL3 as an example of a second-transfer cleaning unit.

The second-transfer roller T2*b* and the belt cleaner CL2 are supported so as to be capable of coming into contact with and separating from the intermediate transfer belt BT. When a color image is to be formed, the second-transfer roller T2*b* and the belt cleaner CL2 separate from the intermediate transfer belt BT until the unfixed toner image of the last color has been first-transferred onto the intermediate transfer belt BT. The second-transfer roller cleaner CL3 moves to come into contact with and separate from the intermediate transfer belt BT together with the second-transfer roller T2*b*.

A recording sheet S onto which the toner image or images have been second-transferred is transported to a fixing device F by a post-transfer sheet guide SG2 as an example of a post-transfer guide member and a sheet transport belt BH as an example of a medium transport member. A suction fan BH1 as an example of a suction unit that sucks air in is arranged in the sheet transport belt BH according to the first exemplary embodiment. Sucking air through plural holes (not illustrated) formed in the sheet transport belt BH allows a recording sheet S that has passed the second-transfer area Q4 to be absorbed to and held on the sheet transport belt BH and to be transported to the downstream side.

The fixing device F includes a heating roller Fh as an example of a heat fixing member, and a pressing roller Fp as an example of a pressure fixing member, and the heating roller Fh includes a heater (not illustrated) as a heat source. When a recording sheet S passes a fixing area Q5 that is an area where the heating roller Fh and the pressing roller Fp are brought into contact with each other, the unfixed toner image on the surface of the recording sheet S is heated and fixed by the heat of the heater and the pressure of the pressing roller Fp. An oil applying device Ft as an example of a release agent supply unit is arranged upward and leftward of the heating roller Fh so as to be provided upstream the fixing area Q5 in the direction of rotation, and applies oil to the surface of the heating roller Fh to facilitate the removal of the recording sheet S from the heating roller Fh. A cleaning web Fw as an example of a fixing cleaner that cleans the surface of the heating roller Fh is arranged upward and rightward of the heating roller Fh so as to be provided downstream the fixing area Q5 in the direction of rotation.

A recording sheet S onto which the toner image or images have been fixed is transported to a sheet discharge roller Rh as an example of a medium discharge member along a sheet discharge path SH2 as an example of a medium transport path located downstream the fixing area Q5, and is discharged to outside from a discharge opening Ka formed in a side wall of the copying machine body U1.

The sheet discharge path SH2 is connected to a sheet reversing path SH3 provided upstream the discharge roller Rh, as an example of a medium transport path, and a switching gate GT1 as an example of a switching member is provided at a connection portion between the sheet discharge path SH2 and the sheet reversing path SH3. The switching gate GT1 selectively switches a recording sheet transported along the sheet discharge path SH2 to one of the discharge roller Rh side or the sheet reversing path SH3 side.

The sheet reversing path SH3 is connected to a sheet circulating path SH4 as an example of a medium transport path, and a switching gate GT2 as an example of a switching member is provided at a connection portion between the sheet reversing path SH3 and the sheet circulating path SH4. The switching gate GT2 allows a sheet transported from the switching gate G1 along the sheet reversing path SH3 to pass therethrough, and also allows a recording sheet S that has passed therethrough and is transported in the reverse transport direction, or a switched back recording sheet S, to be directed to the sheet circulating path SH4 side. A sheet transported to the sheet circulating path SH4 is re-transported to the second-transfer area Q4 through the paper feed path SH1 with the sheet being turned upside down.

The elements SH1 to SH4 form a sheet transport path SH. Further, the elements Rp, Rs, Rr, Ra, SG1, SG2, and BH form a sheet transport device SH.

Description of Rotary Developing Device

Figure 2:
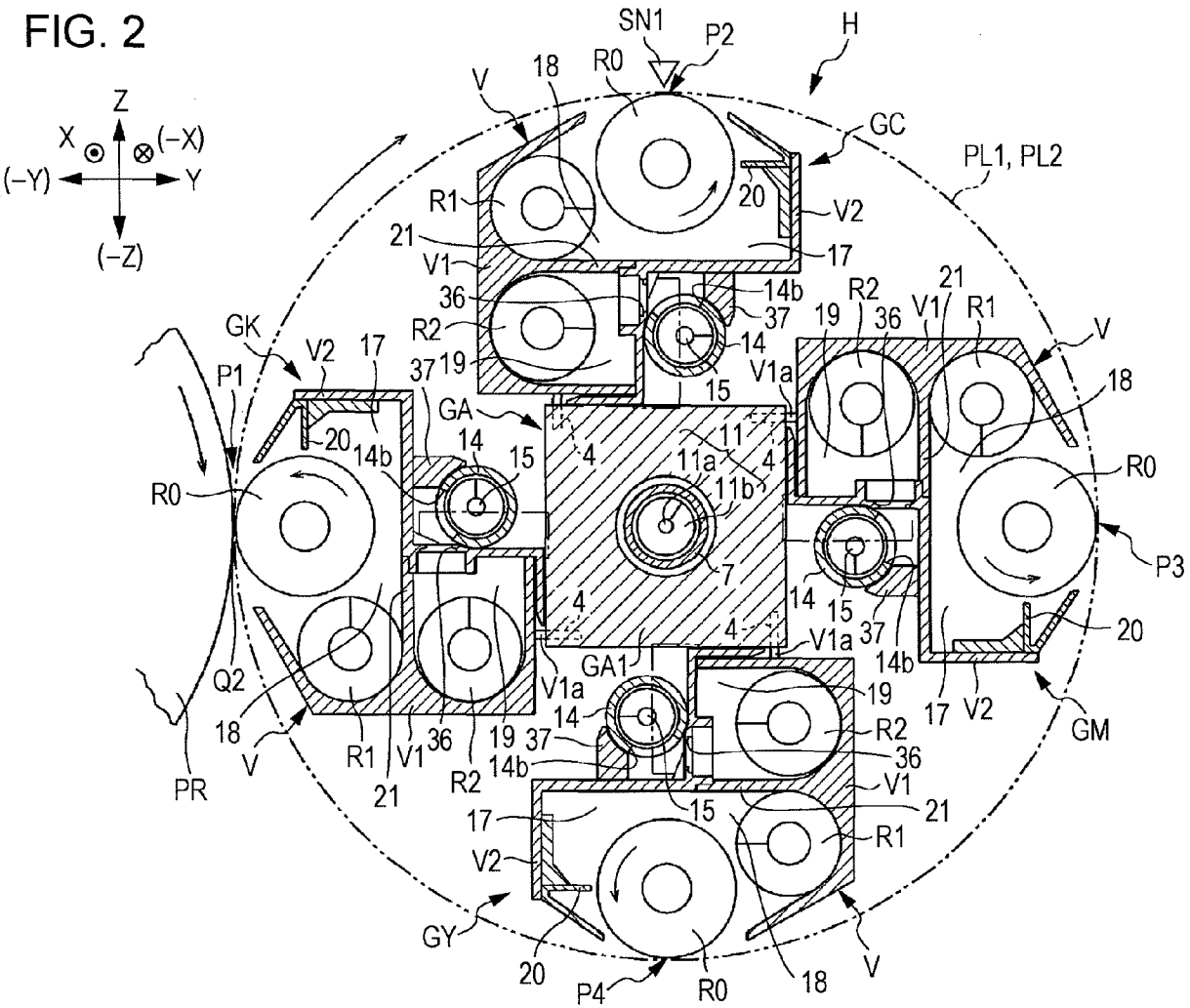
FIG. 2 is an enlarged cross-sectional view of the substantial portion of a rotary developing device according to the first exemplary embodiment of the present invention.

FIG. 2 is an enlarged cross-sectional view of the substantial portion of a rotary developing device according to the first exemplary embodiment of the present invention.

Figure 3:
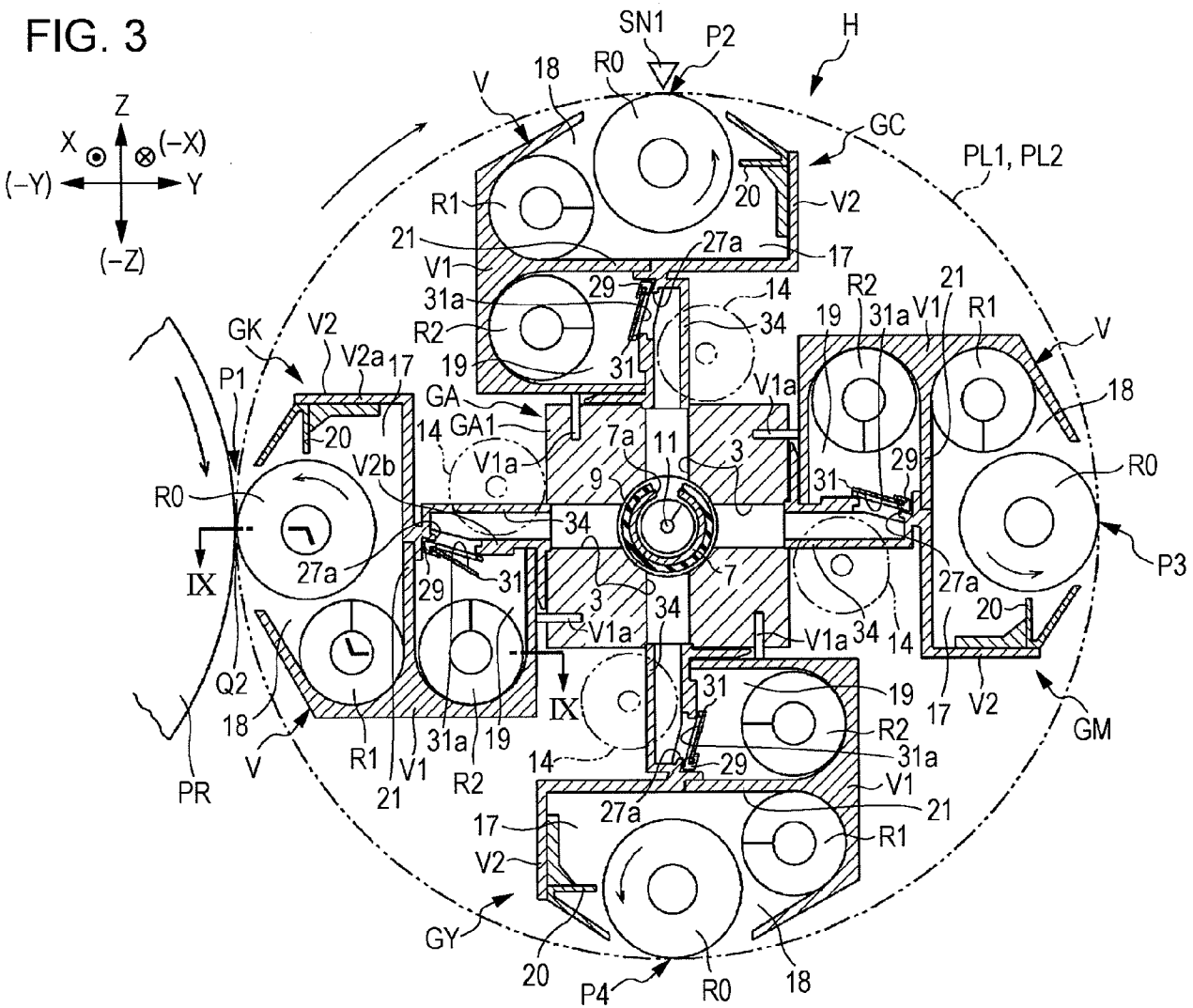
FIG. 3 is an enlarged cross-sectional view of a portion different from that illustrated in FIG. 2 of the rotary developing device according to the first exemplary embodiment of the present invention.

FIG. 3 is an enlarged cross-sectional view of a portion different from that illustrated in FIG. 2 of the rotary developing device according to the first exemplary embodiment of the present invention.

In FIGS. 2 and 3, the developing device G has the rotational shaft GA extending in the back and forth direction, as an example of the center of rotation, and the developing units GY, GM, GC, and GK of four, Y, M, C, and K colors that are supported at the rotational shaft GA. The developing units GK, GC, GM, and GY are supported by a developing container support member H. In the first exemplary embodiment, the developing container support member H has a pair of forward and rearward rotation plates PL1 and PL2 (see FIG. 5) described below to which the developing units GK, GC, GM, and GY are attached, and the rotational shaft GA.

In FIGS. 2 and 3, the developing units GY, GM, GC, and GK are configured to rotationally move in accordance with the rotation of the rotational shaft GA and sequentially stop at a first stop position P1 as an example of a developing position, a second stop position P2 as an example of a first rotation position that rotates 90° with respect to the first stop position P1, a third stop position P3 that rotates 90° with respect to the second stop position P2, and a fourth stop position P4 as an example of a second rotation position that rotates 90° with respect to the third stop position P3.

In the first exemplary embodiment, the first stop position P1 may be a developing position at which the latent image on the surface of the image holding member PR is developed into a visible image. The first stop position P1 may also be a discharge position at which a developer is discharged, and a developer replenishing position at which the replenishment of a developer is performed. The developing operation of each of the developing units GY, GM, GC, and GK is performed at the first stop position.

A rotational force is transmitted to the developing roller R0 of the developing unit GK, GY, GM, or GC that stops at the first stop position P1 to make it possible to execute the developing operation. The developing unit GK, GY, GM, or GC that stops at the first stop position P1 is replenished with a new developer and a degraded developer is allowed to be discharged.

Figure 4:
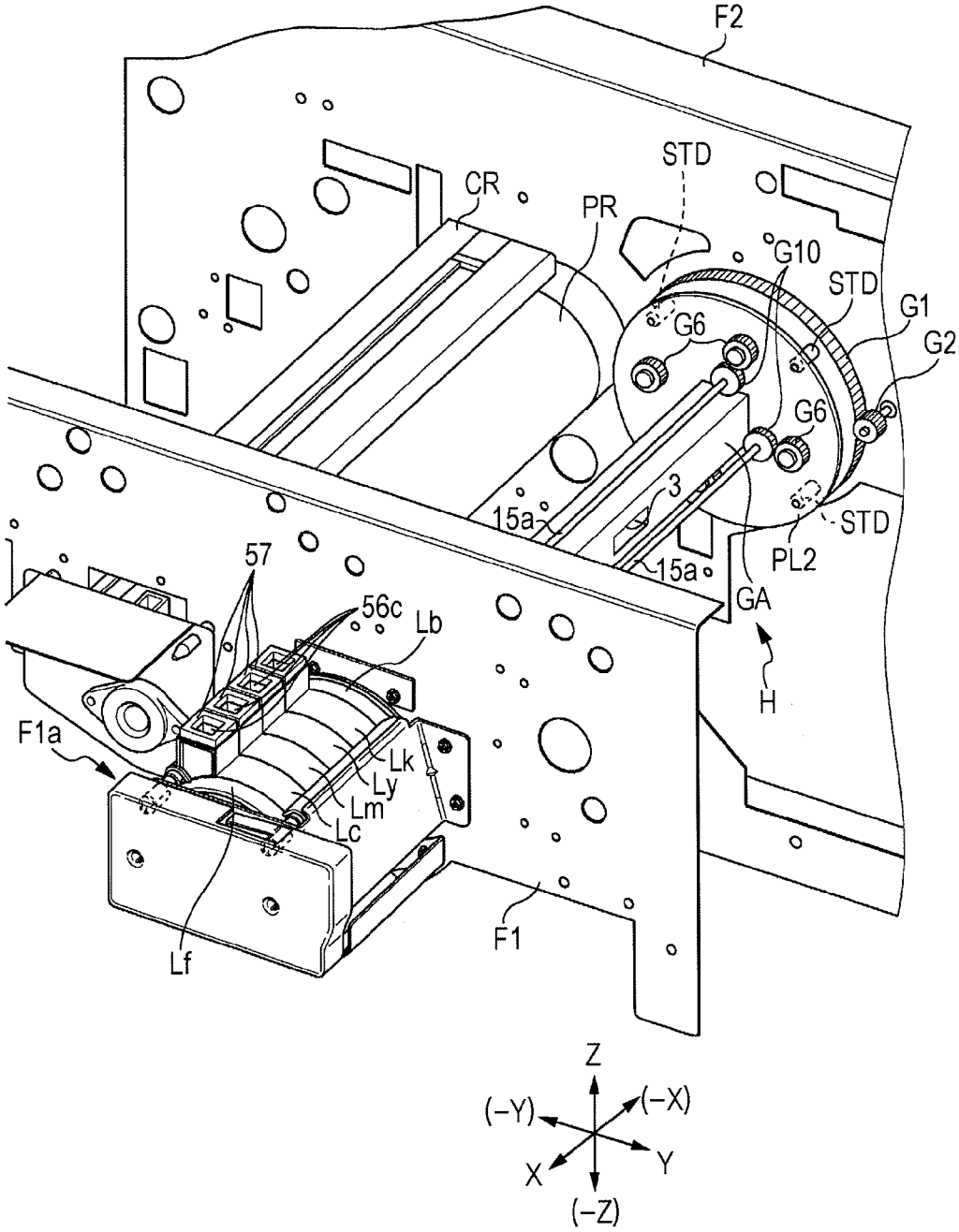
FIG. 4 is a perspective view of a developing container support member used in the first exemplary embodiment.

FIG. 4 is a perspective view of a developing container support member used in the first exemplary embodiment.

Figure 5:
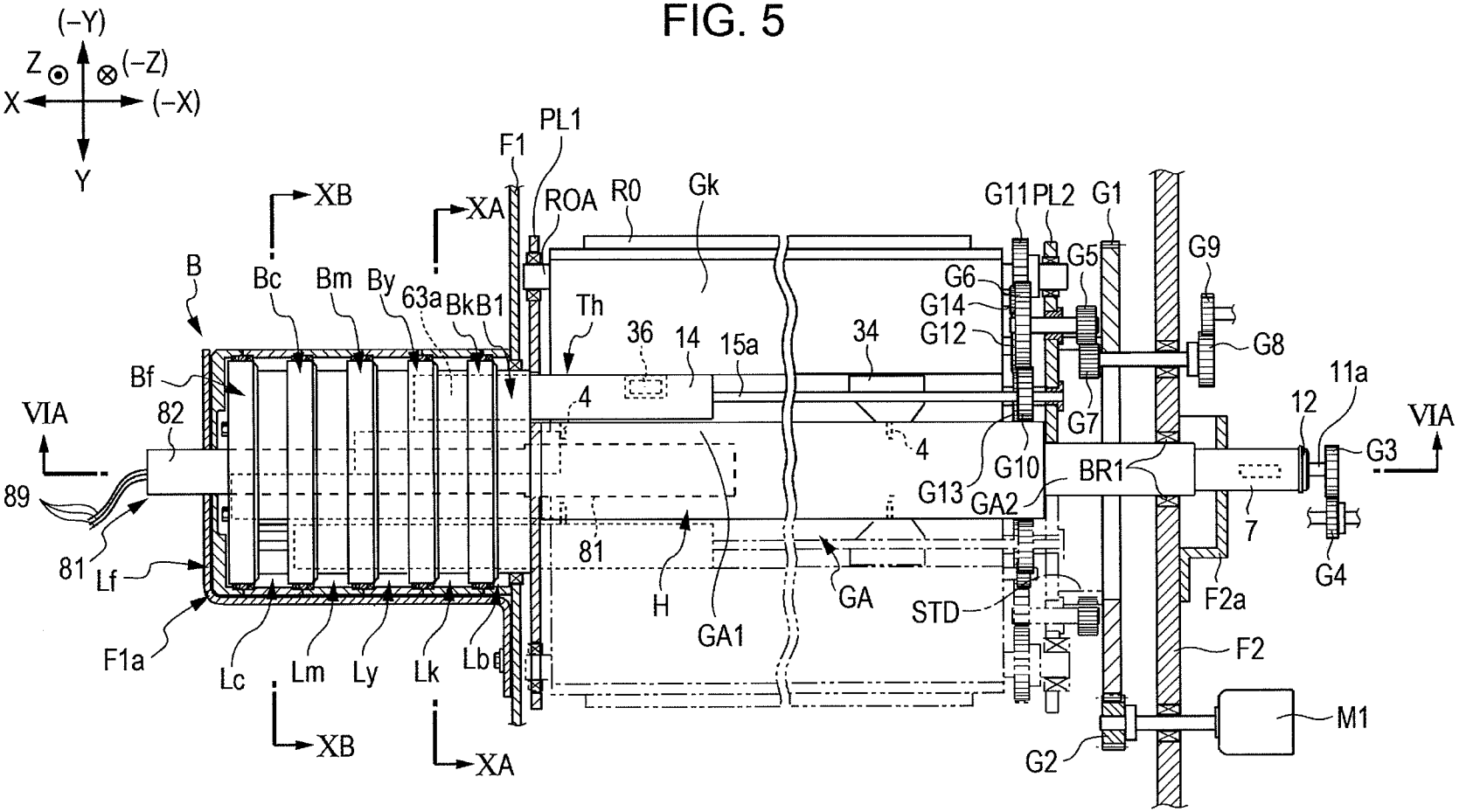
FIG. 5 is a cross-sectional view of the substantial portion of the developing device according to the first exemplary embodiment.

FIG. 5 is a cross-sectional view of the substantial portion of a developing device according to the first exemplary embodiment.

Figure 6A:
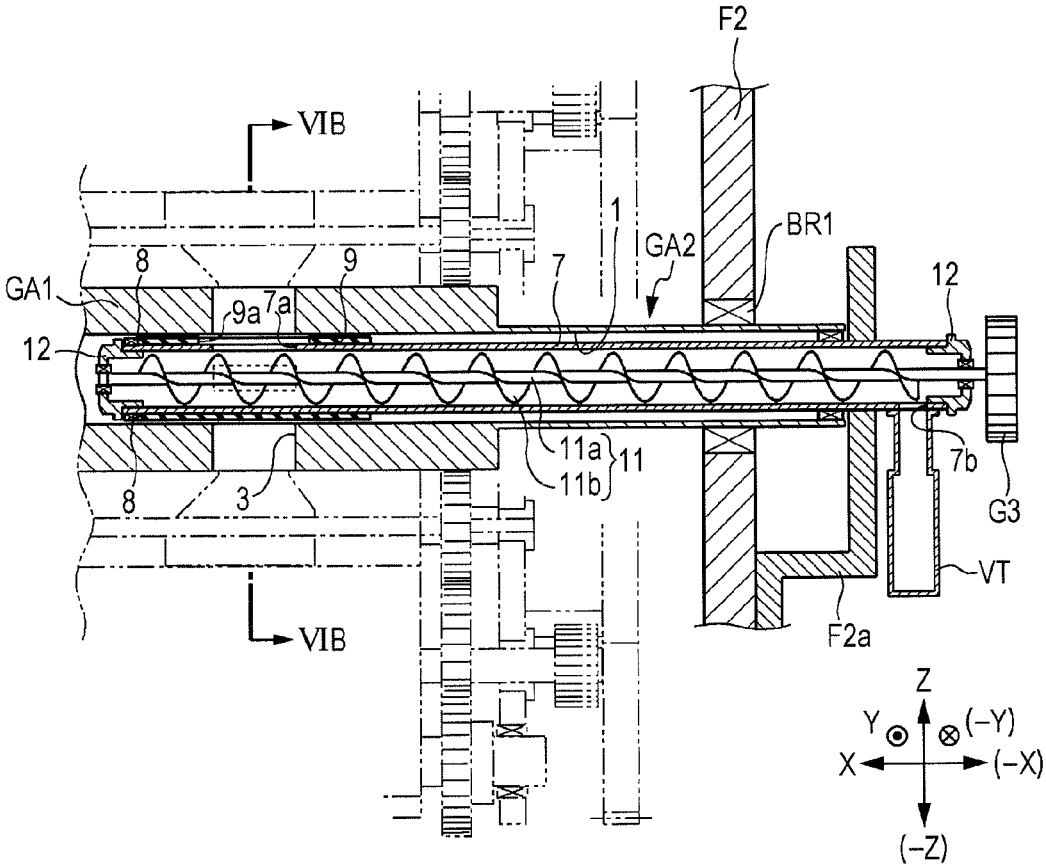
FIGS. 6A and 6B are enlarged cross-sectional views of a rotational shaft provided in the rotary developing device according to the first exemplary embodiment of the present invention, where
Figure 6B:
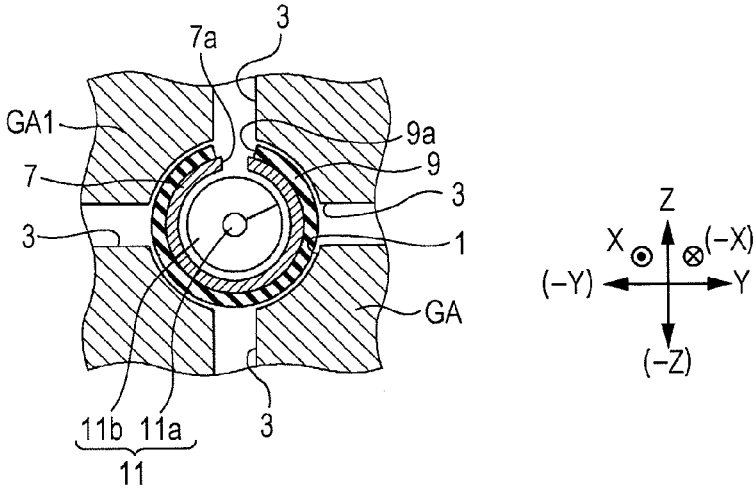

FIGS. 6A and 6B are enlarged cross-sectional views of a rotational shaft provided in a rotary developing device according to the first exemplary embodiment of the present invention. FIG. 6A is a cross-sectional view taken along line VIA-VIA of FIG. 5, and FIG. 6B is a cross-sectional view taken along line VIB-VIB of FIG. 6A.

Figure 7:
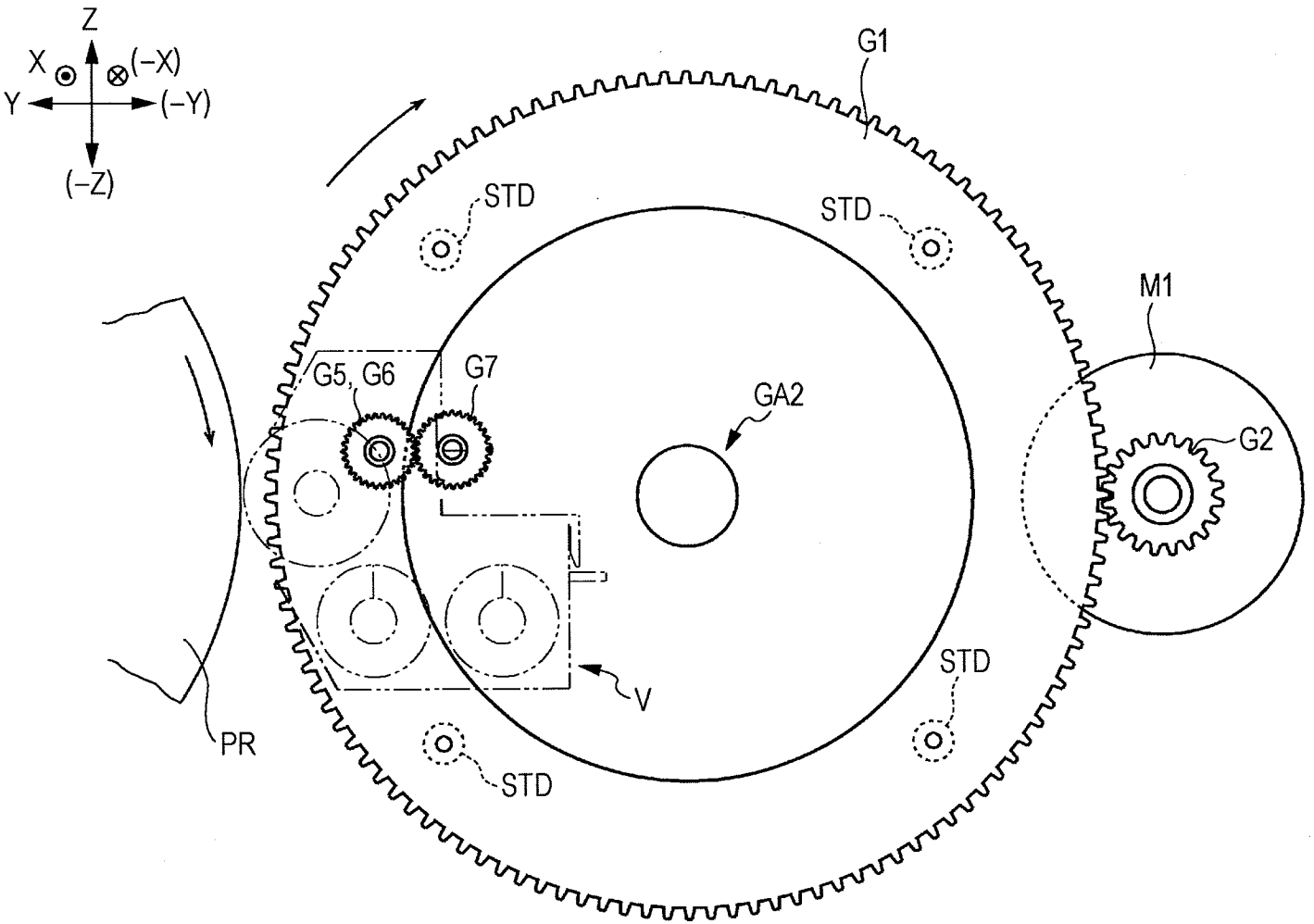
FIG. 7 illustrates a fixed rotational force transmission member for transmitting a rotational force to the rotary developing device that rotationally moves.

FIG. 7 illustrates a fixed rotational force transmission member for transmitting a rotational force to the rotary developing device that rotationally moves.

In FIGS. 4 to 7, the copying machine body U1 has a front fixed frame F1 and a rear fixed frame F2 as examples of a frame member, and a fixed cylindrical member F1*a* as an example of a forward end support unit is fixed to a forward surface of the front fixed frame F1.

The rotational shaft GA of the rotary developing device G has a rectangular cylindrical portion GA1 as an example of a body of an axial portion, and a rearward side cylindrical portion GA2 as an example of an axial rearward portion. The rectangular cylindrical portion GA1 is arranged in a center portion in the axial direction of rotational shaft GA, and has a rectangular cross section. The rearward side cylindrical portion GA2 is arranged in a rearward side portion in the axial direction of the rotational shaft GA. The rearward side cylindrical portion GA2 is supported so as to be rotatable with respect to the rear fixed frame F2 through a bearing BR1.

A disk-shaped front rotation plate PL1 and a disk-shaped rear rotation plate PL2 as examples of a rotational frame member are supported at the forward end and rearward end of the rectangular cylindrical portion GA1, respectively.

The rotational shaft GA, the front rotation plate PL1, and the rear rotation plate PL2 form the developing container support member H according to the first exemplary embodiment that rotates while supporting the developing units GK, GY, GM, and GC of the four colors K, Y, M, and C.

In FIGS. 5 and 7, a ring gear G1 as an example of a rotation transmission member is fixed to the rearward surface of the rear rotation plate PL2 through four studs STD as an example of a coupling member. The ring gear G1 engages with a gear G2 as an example of a rotation transmission member. The gear G2 is coupled to the output axis of a rotary motor M1 as an example of a developing device driving source supported at the rear fixed frame F2.

Therefore, the ring gear G1 rotates when the rotary motor M1 rotates, and the developing container support member H rotates in accordance with the rotation of the ring gear G1. That is, the developing device G rotates and the developing units GY, GM, GC, and GK rotationally move.

In FIGS. 6A and 6B, a through passage 1 having a circular cross section is formed in the rotational shaft GA so as to extend in the axial direction from the rearward portion to the rearward end of the rotational shaft GA.

Discharge developer flow inlets 3 as examples of a portion into which discharge developers flow are formed in the rearward portion of the rectangular cylindrical portion GA1 of the rotational shaft GA. The discharge developer flow inlets 3 are connected to the through passage 1 from four side surfaces extending in the axial direction of the rectangular cylindrical portion GA1. In FIG. 5, a pin insertion hole 4 as an example of a developing unit coupling portion is formed in each of the side surfaces of the rectangular cylindrical portion GA1.

In FIGS. 6A and 6B, a cylindrical developer discharge cylinder 7 as an example of a discharge developer transport unit is arranged in the through passage 1 in the rotational shaft GA so as to extend in the axial direction. The rearward end portion of the developer discharge cylinder 7 is fixedly supported at a discharge cylinder fixing member 2*a* as an example of a discharge path support member, and the discharge cylinder fixing member 2*a* is fixed to the rear fixed frame F2. The forward end portion of the developer discharge cylinder 7 is supported at the through passage 1 in the rotational shaft GA through a bearing 8 as an example of a bearing member. In the first exemplary embodiment, the forward end of the developer discharge cylinder 7 extends forward of the discharge developer flow inlets 3.

In FIG. 6B, a flow connection opening 7*a* as an example of an inlet connecting portion is formed in a forward portion at the forward end of the discharge cylinder 7. The flow connection opening 7*a* is arranged so that the position in the axial direction corresponds to each of the inlets 3 in the rectangular cylindrical portion GA1 of the rotational shaft GA. A flow outlet 7*b* is formed in the rearward end of the discharge cylinder 7. The flow outlet 7*b* is connected to the inlet of a collection box VT as an example of a collection vessel.

In FIGS. 6A and 6B, a magnet seal 9 as an example of a leakage preventing member is adhered and fixed to a portion on the outer peripheral surface of the discharge cylinder 7 which is adjacent to the flow connection opening 7*a*. A sheet communication opening 9*a* as an example of an opening is formed in the magnet seal 9, and is always connected to the flow connection opening 7*a* in the discharge cylinder 7.

In the first exemplary embodiment, a small gap is formed between the outer peripheral surface of the magnet seal 9 and the inner peripheral surface of the rotational shaft GA so that the contact friction resistance does not occur when the rotational shaft GA rotates. The magnet seal 9 is a member for preventing a developer from moving to the other discharge developer flow inlets 3 in the rotational shaft GA through the gap between the outer peripheral surface of the discharge cylinder 7 and the inner peripheral surface of the rotational shaft GA.

In FIGS. 6A and 6B, a discharge transport screw 11 as an example of a discharge developer transport member is arranged in the discharge cylinder 7. The discharge transport screw 11 has a rotational shaft 11*a*, and a transport blade 11*b* supported on the outer periphery of the rotational shaft 11*a*. In FIGS. 5 and 6A, the forward and rearward ends of the rotational shaft 11*a* of the discharge transport screw 11 are rotatably supported at a transport member support member 12, and the transport member support member 12 is fixedly supported at each of the forward and rearward ends of the discharge cylinder 7.

In FIGS. 5, 6A and 6B, the rotational shaft 11*a* of the discharge transport screw 11 passes through the transport member support member 12 and extends rearward, and a gear G3 as an example of a rotation transmission member is fixedly supported at the rearward end of the rotational shaft 11*a*. The gear G3 engages with a gear G4 as an example of a rotation transmission member. The rotation of a developer discharge motor as an example of a drive source (not illustrated) is transmitted to the gear G4. When the developer discharge motor is driven, the gear G3, the gear G4, and the rotational shaft 11*a* are integrally driven to rotate.

In the first exemplary embodiment, the discharge transport screw 11 stops rotating when the developing units GY, GM, GC, and GK stop at positions other than the first stop position P1.

In FIGS. 4, 5, and 7, the rear rotation plate PL2 is provided with four input gears G5 as examples of a rotation transmission member, and four integral rotation gears G6 supported coaxially with or substantially coaxially with the input gears G5, so as to correspond to the developing units GY, GM, GC, and GK. The input gears G5 are arranged on the rearward surface side of the rear rotation plate PL2, and the four integral rotation gears G6 are provided on the forward surface side of the rear rotation plate PL2. Each of the input gears G5 is connected to a gear G7 as an example of a rotation transmission member when a corresponding one of the developing unit GY, GM, GC, and GK moves to the first stop position P1, and is disconnected from the gear G7 when the corresponding one of the developing unit GY, GM, GC, and GK moves apart from the first stop position P1.

The rearward end portion of the rotational axis of the gear G7 passes through inside the ring gear G1, and is rotatably supported at the rear rotation plate PL2 on the rear side of the ring gear G1. A gear G8 as an example of a rotation transmission member supported coaxially with or substantially coaxially with the gear G7 on the rearward surface side of the rear rotation plate PL2 engages with a gear G9 as an example of a rotational input member. The rotation of a motor as an example of a drive source (not illustrated) for driving the developing units GY, GM, GC, and GK is transmitted to the gear G9.

Figure 8A:
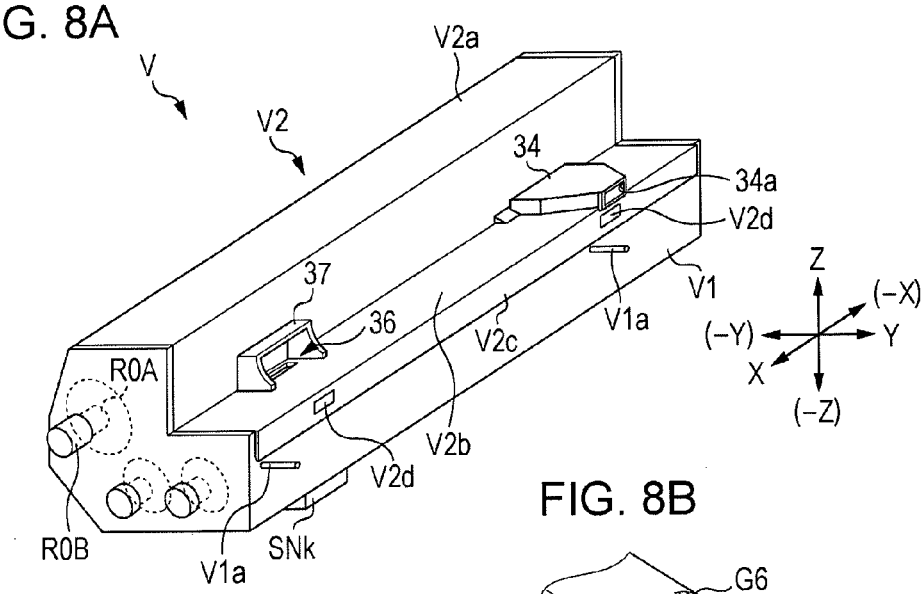
FIGS. 8A to 8C are perspective views of a developing unit according to the first exemplary embodiment, where
Figure 8B:
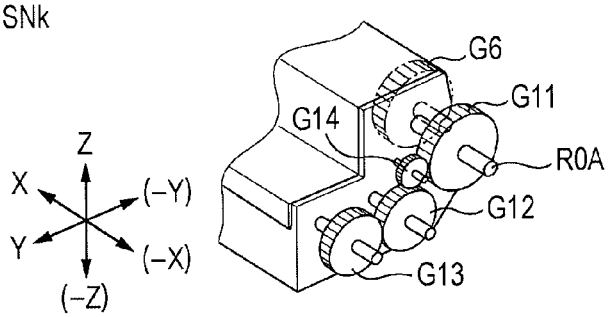
Figure 8C:
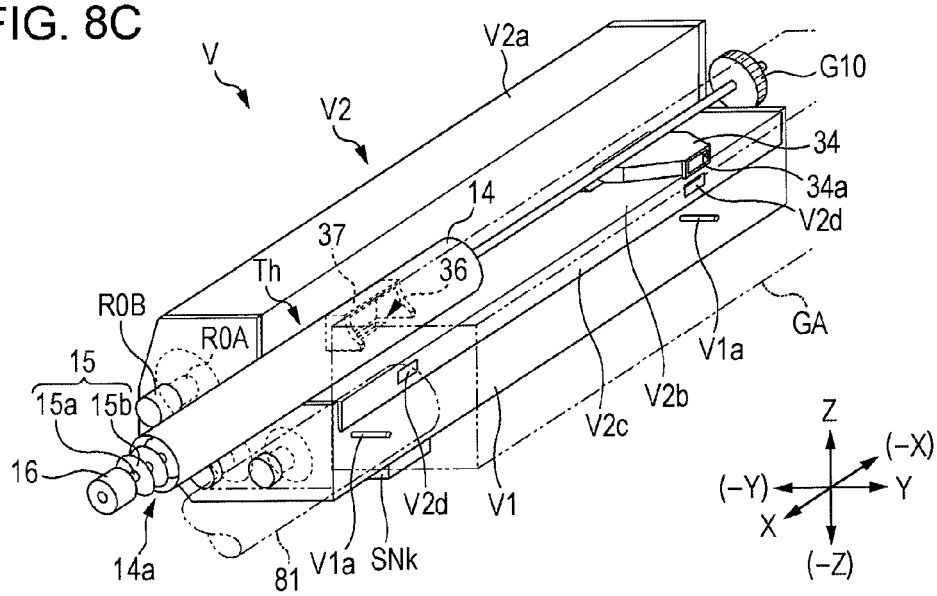

FIGS. 8A to 8C are perspective views of a developing unit according to the first exemplary embodiment. FIG. 8A illustrates a state where a replenishing cylinder has been removed from the developing unit, FIG. 8B illustrates the arrangement of gears provided in a rearward end portion of the developing unit illustrated in FIG. 8A, and FIG. 8C illustrates a state where a replenishing cylinder is attached to the developing unit.

Figure 9:
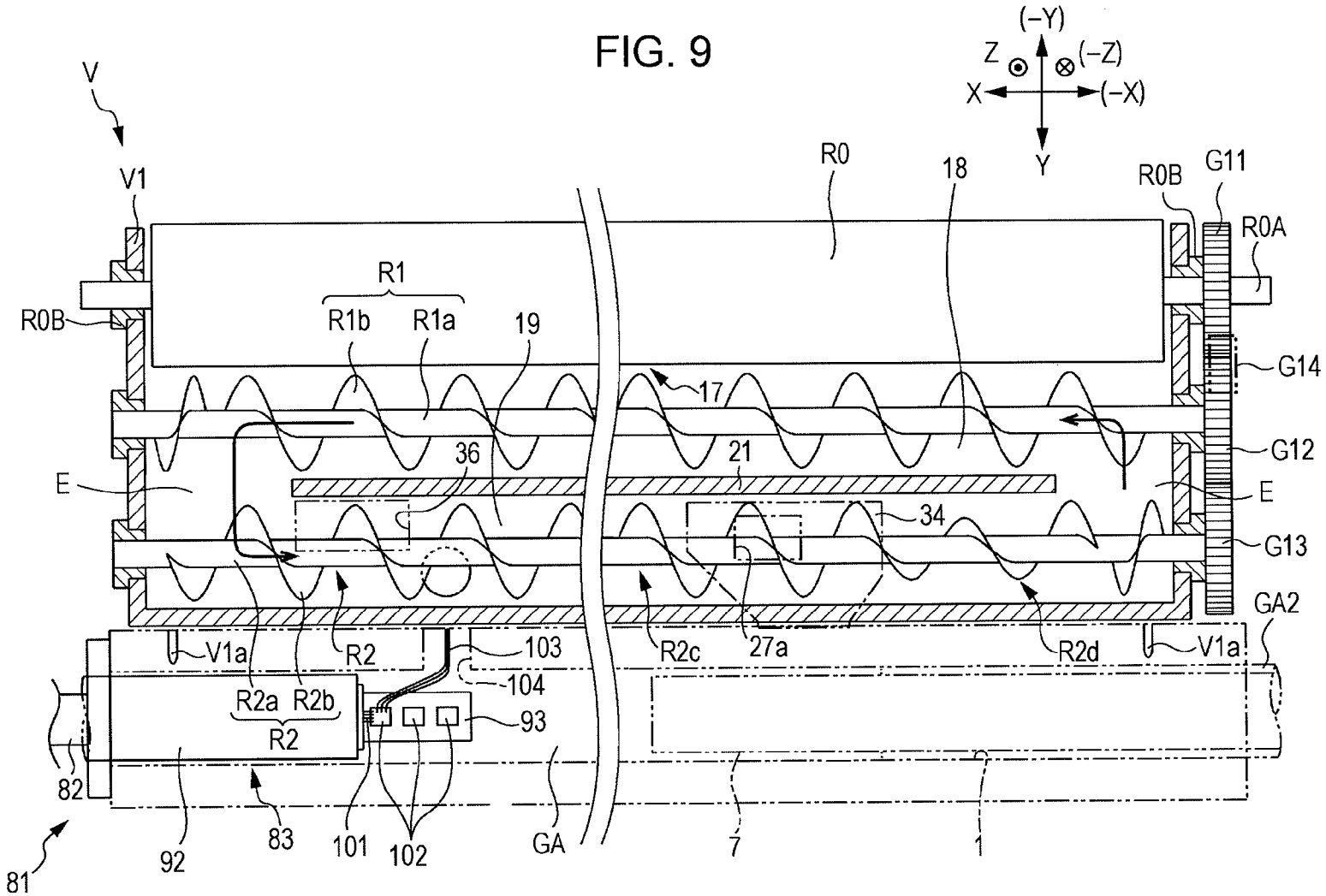
FIG. 9 is a cross-sectional view taken along line IX-IX of FIG. 3.

FIG. 9 is a cross-sectional view taken along line IX-IX of FIG. 3.

In FIGS. 5 and 8A to 8C, a developer replenishing member Th replenishes a developing container V of each of the developing units GY, GM, GC, and GK that has moved at the first stop position P1 with a new developer. The developer replenishing member Th includes a replenishing cylinder 14 extending in the back and forth direction, and a replenishment transport member 15 that transports the replenishment developer in the replenishing cylinder 14. The replenishing cylinder 14 has a transport inlet 14*a* that opens at the forward end thereof, and a replenishment flow inlet 14*b* that is connected to the developing container V in the manner illustrated in FIG. 2. In FIG. 8C, the replenishment transport member 15 has a rotational shaft 15*a* and a transport blade 15*b* fixedly supported on the periphery of the rotational shaft 15*a*.

The forward end of the rotational shaft 15*a* of the replenishment transport member 15 extends forward with respect to the transport inlet 14*a* at the forward end of the replenishing cylinder 14. As illustrated in FIG. 8C, a bearing 16 as an example of a bearing member is attached to the forward end of the rotational shaft 15*a*. The rearward end of the rotational shaft 15*a* is rotatably supported at the rear rotation plate PL2. A gear G10 as an example of a rotation transmission member is attached to the rearward end portion of the rotational shaft 15*a*. In a state where the rearward end of the rotational shaft 15*a* is supported at the rear rotation plate PL2, the gear G10 engages with one of the gears G6 illustrated in FIG. 4.

Next, the developing units GY, GM, GC, and GK will be described. Since the developing units GY, GM, GC, and GK have similar configurations, the developing unit GK will be described and the developing units GY, GM, GC, and GK will not be described in detail.

In FIGS. 2, 3, 5, and 8A to 8C, the developing container V of the developing unit GK has a container body V1 as an example of a container lower portion, and a container cover V2 as an example of a container upper portion. The developing container V contains a two-component developer composed of negatively charged toner and magnetic carrier charged positively.

In FIG. 8A, a pair of forward and rearward projecting pins V1*a* and V1*a* as an example of a coupled unit projecting rightward is supported on an outer side surface of the container body V1. In FIGS. 2 and 5, the pair of projecting pins V1*a* and V1*a* are inserted into pin insertion holes 4 in the rotational shaft GA, and the developing unit GK is positioned and fixed.

In FIGS. 2, 3, and 9, the developing container V includes a developing roller chamber 17 as an example of a developing member that accommodates the developing roller R0, a supply chamber 18 adjacent to the developing roller chamber 17, as an example of a first developer accommodating unit, and a stirring chamber 19 adjacent to the supply chamber 18, as an example of a second developer accommodating unit. A thickness regulating member 20 that regulates the thickness of the developer on the surface of the developing roller R0 is arranged in the developing roller chamber 17. A supply auger R1 as an example of a first stirring member is arranged in the supply chamber 18, and an admix auger R2 as an example of a second stirring member is arranged in the stirring chamber 19.

The augers R1 and R2 form a stirring transport member R1+R2 that transports the developer while stirring the developer in the supply chamber 18 and the stirring chamber 19. Further, the supply chamber 18 and the stirring chamber 19 form a stirring transport area 18+19.

As illustrated in FIG. 9, a partition wall 21 as an example of a partition member is provided in a portion other than the forward end portion and the rearward end portion between the supply chamber 18 and the stirring chamber 19. The supply chamber 18 and the stirring chamber 19 are connected to each other at connection portions E at both end portions in the back and forth direction.

In FIG. 9, the supply auger R1 arranged in the supply chamber 18 has a rotational shaft R1*a* extending in the developer transport direction, and a transport blade Rib supported on the outer periphery of the rotational shaft R1*a*. The admix auger R2 arranged in the stirring chamber 19 also has a rotational shaft R2*a* and a transport blade R2*b* in a similar manner. In the first exemplary embodiment, the transport blade R2*b* has a normal transport portion R2*c* having substantially the same transport force as the transport blade R1*b*, and a low transport portion R2*d* having a lower transport force and arranged rearward of the normal transport portion R2*c*. The low transport portion R2*d* is provided downstream a developer discharge opening formed in the container cover V2, which will be described below, in the developer transport direction.

The developing roller R0 illustrated in FIGS. 2, 3, and 9 may be a conventional one formed of a magnetic roller having a sleeve on an outer side thereof. The developer in the supply chamber 18 is absorbed to the surface of the developing roller R0 by the magnetic force of the magnetic roller. The developer whose thickness is regulated by the thickness regulating member 20 is transported to the developing area Q2.

In FIGS. 2 to 4, 5, 8B, and 9, a roller shaft R0A as an example of a rotational shaft of the developing roller R0 has both end portions projecting outward from the end walls of the developing container V. Bearings R0B as examples of a bearing member are attached to the outer ends of the roller shaft R0A, and a gear G11 as an example of a rotation transmission member is attached to the rearward end portion of the roller shaft R0A. In FIG. 9, both end portions of each of the rotation shafts R1*a* and R2*a* of the augers R1 and R2 are rotatably supported by the end walls of the developing container V, and the rearward end portions of the shafts R1*a* and R2*a* project outward. Gears G12 and G13 as examples of a rotation transmission member are fixedly supported at the rearward end portions of the shafts R1*a* and R2*a* of the augers R1 and R2, respectively.

In FIG. 8B, the gears G12 and G13 engage with each other, and the gears G11 and G12 are connected to each other through an intermediate gear G14.

Further, in FIG. 5, in a state where each of the developing units GK, GY, GM, and GC is attached to the developing container support member H, the gear G11 at the rearward end portion of the roller shaft R0A engages with one of the integral rotation gears G6. Therefore, when a rotational force is input to the input gear G5, the rotational force is transmitted to the gear G11 at the rearward end portion of the roller shaft R0A from the gear G6 that rotates integrally with the input gear G5, and the rotation is transmitted sequentially to the gears G14, G12, and G13 from the gear G11. When the gears G11, G12, and G13 rotate, the developing roller R0 and the stirring transport member R1+R2 rotate. In accordance with the rotation of the stirring transport member R1+R2, the developer in the supply chamber 18 and the developer in the developer in the stirring chamber 19 circulate while being transported in opposite directions.

Since the gear G10 at the rearward end of the replenishment rotational shaft 15*a* also engages with the integral rotation gear G6, the rotation is also transmitted to the replenishment rotational shaft 15*a*.

In FIGS. 2, 3, and 8A to 8C, the container cover V2 has an accommodation wall V2*a* forming the developing roller chamber 17, a container upper wall V2*b* arranged above the stirring chamber 19 of the container body V1, and a container side wall V2*c* extending downward from the right side of the container upper wall V2*b* and coming into contact with the side wall of the container body V1.

In FIG. 3, the rearward portion of the container upper wall V2*b* of the stirring chamber 19 that stops at the developing position P1 is formed so as to expand upward, and the expanding portion has a developer discharge opening 27*a* formed therein. A shutter 31 as an example of an opening and closing member is provided on the lower side of the discharge opening 27 so that the left end of the shutter 31 is rotatably supported about a rotational axis 29 extending in the back and forth direction.

The shutter 31 comes into contact with a stop member (not illustrated) and moves between an opening position indicated by the developing position P1 in FIG. 3 and a closing position indicated by the third stop position P3 at which the discharge opening 27 is closed. Extra developer that increases so that the position of the top surface of the developer becomes high may be deposited and accumulated on an upper surface 31*a* of the shutter 31 that has moved to the opening position.

Therefore, the developer on the extra developer accumulation portion (i.e., upper surface) 31*a* is discharged from the discharge opening 27*a* when the shutter 31 rotationally moves to the closing position.

A discharge connection member 34 is supported on the upper side of the discharge opening 27. In FIGS. 3 and 8A to 8C, a connection opening 34*a* is formed on the right end side of the discharge connection member 34. When the developing container V is attached to the developing container support member H, the connection opening 34*a* is connected to the corresponding one of the discharge developer flow inlets 3 formed in the rectangular cylindrical portion GA1 of the rotational shaft GA and is then connected to the discharge cylinder 7 in the rotational shaft GA.

Therefore, the developer discharged from the discharge opening 27 drops into the discharge cylinder 7 from the discharge connection member 34 and is transported when the developing unit GK moves to the second stop position P2. Then, the developer in the discharge cylinder 7 is transported rearward by the discharge transport screw 11, and is collected into the collection box VT from the flow outlet 7*b*.

In FIGS. 3, 8A to 8C, and 9, a replenishing opening 36 is formed on the forward side of the upper surface of the stirring chamber 19.

In FIGS. 8A to 8C, a replenishing cylinder support member 37 is provided so as to have a pair of cylinder-receiving arc surfaces in front of and behind the replenishing opening 36 on the surface of the developing container V. The pair of cylinder-receiving arc surfaces of the replenishing cylinder support member 37 support cylindrical outer side surface of the replenishing cylinder 14.

Figure 10A:
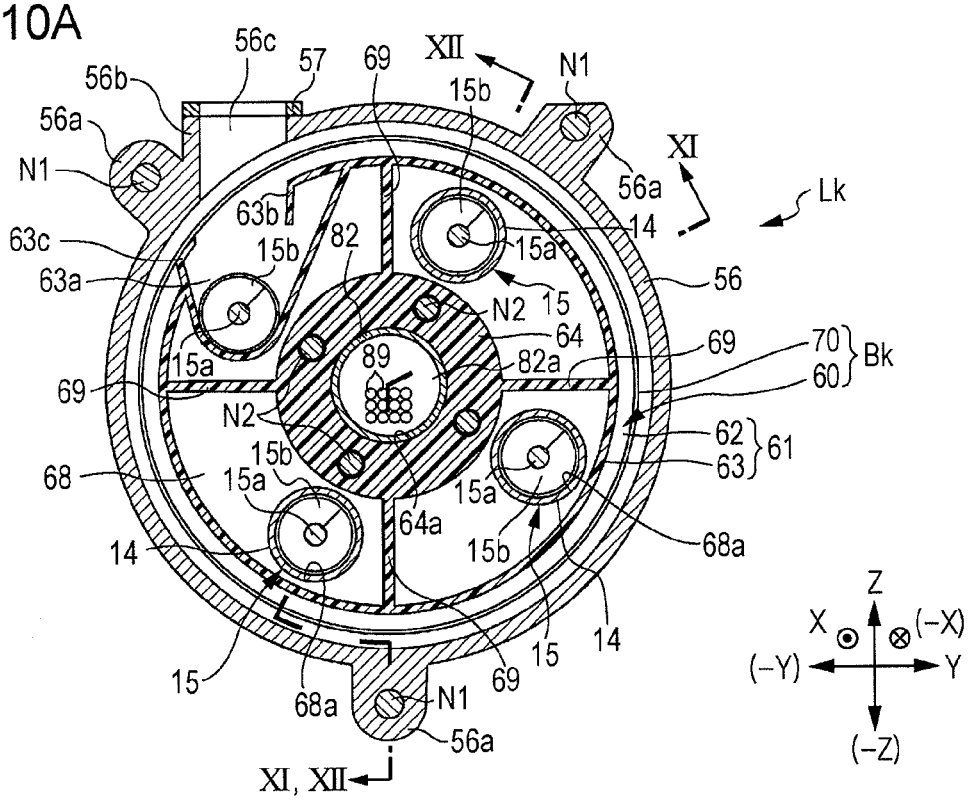
FIGS. 10A and 10B illustrate ring-shaped coupling members for the K, Y, M, and C colors according to the first exemplary embodiment, and rotational cylindrical members rotatably supported therein, where
Figure 10B:
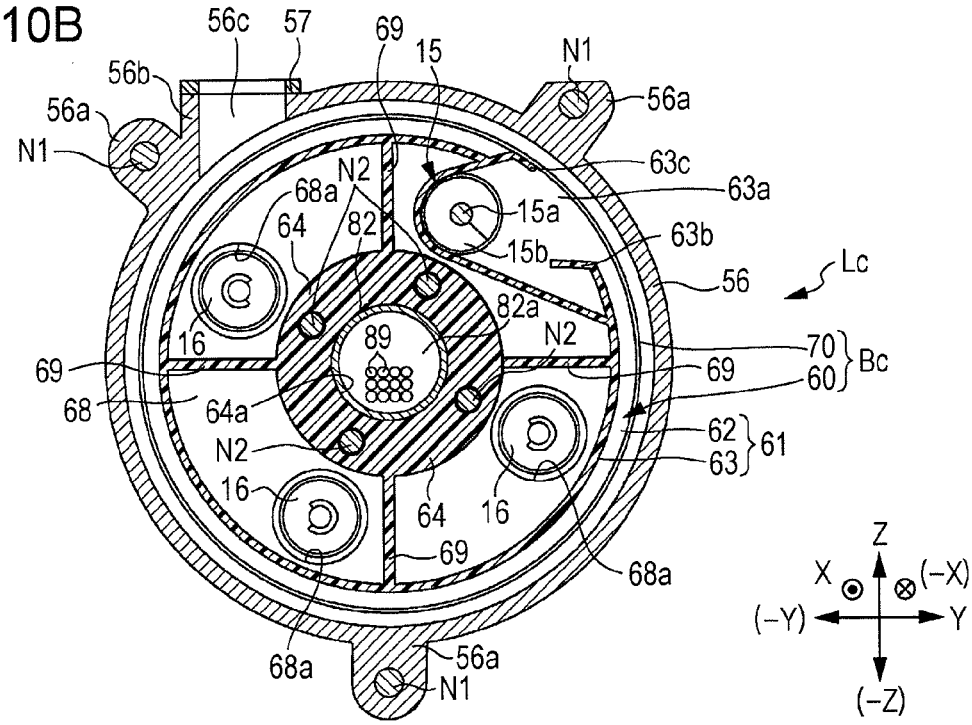

FIGS. 10A and 10B illustrate ring-shaped coupling members for the K, Y, M, and C colors according to the first exemplary embodiment, and a rotational cylindrical member rotatably supported therein. FIG. 10A is a cross-sectional view taken along line XA-XA of FIG. 5, and FIG. 10B is a cross-sectional view taken along line XB-XB of FIG. 5.

Figure 11:
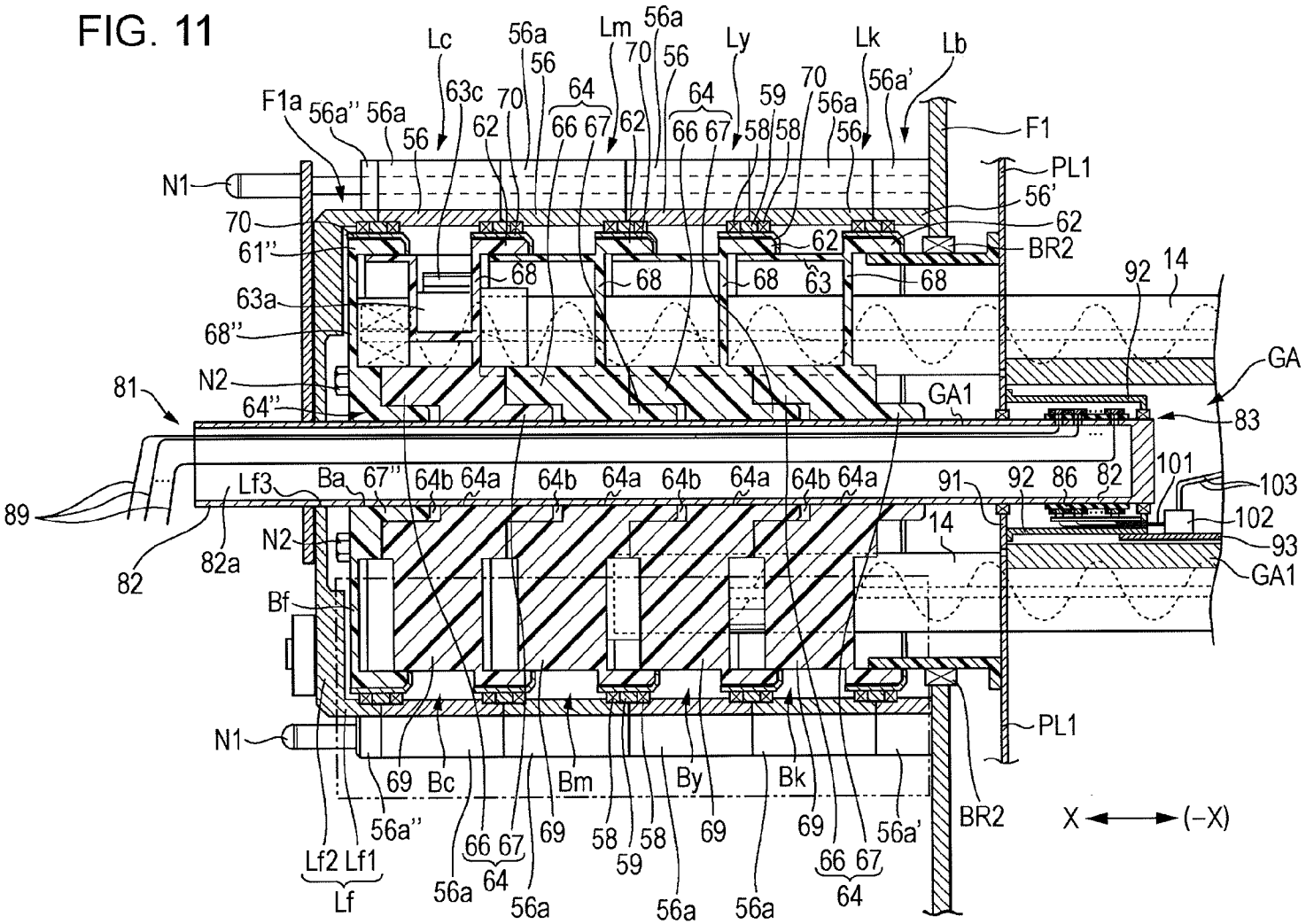
FIG. 11 is a cross-sectional view taken along line XI-XI of FIG. 10A.

FIG. 11 is a cross-sectional view taken along line XI-XI of FIG. 10A.

Figure 12:
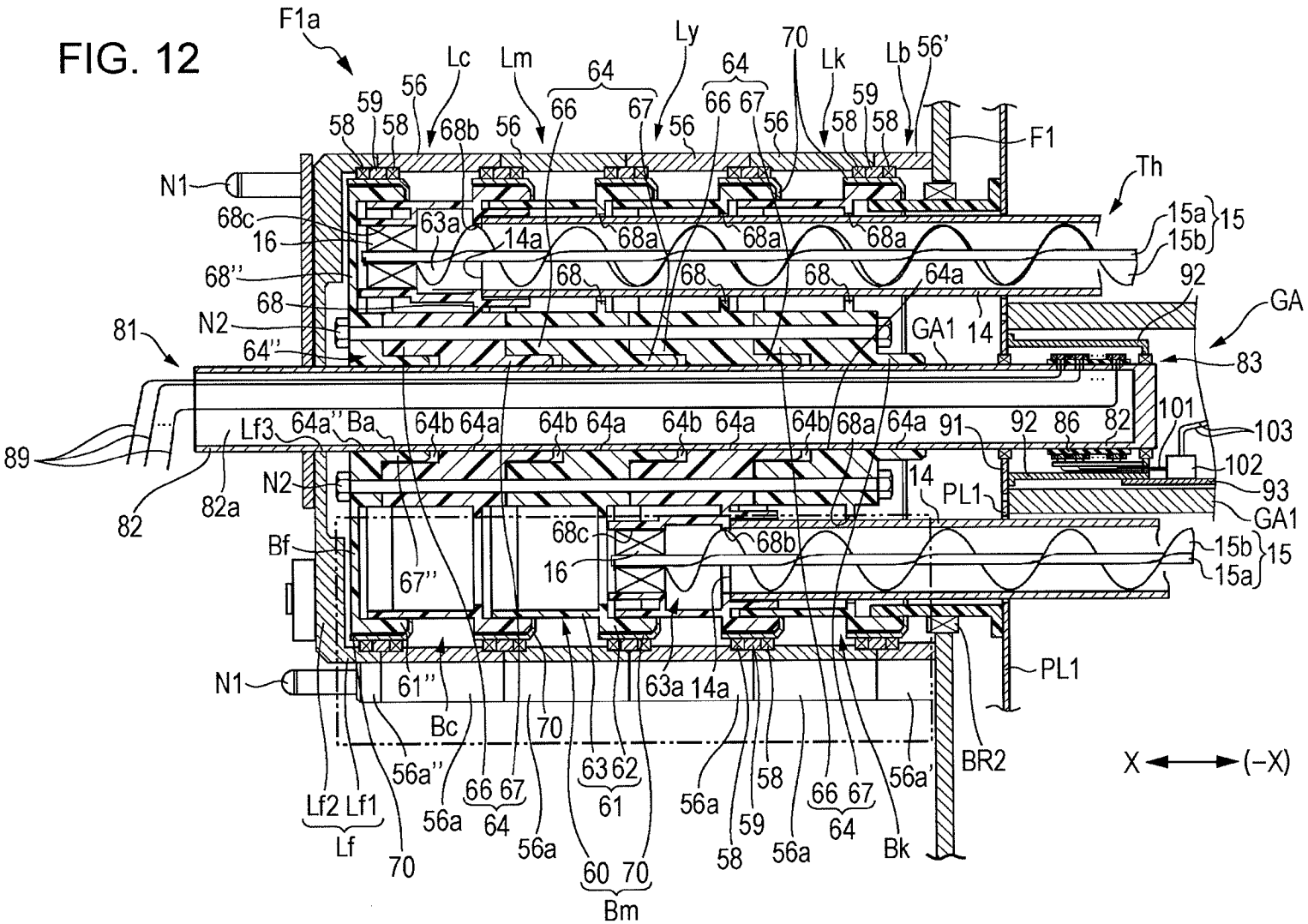
FIG. 12 is a cross-sectional view taken along line XII-XII of FIG. 10A.

FIG. 12 is a cross-sectional view taken along line XII-XII of FIG. 10A.

In FIGS. 4, 11, and 12, a fixed cylindrical member F1*a* as an example of a replenishing unit fixing unit is fixed to the forward surface side of the front fixed frame F1 located forward of the replenishing cylinder 14. The fixed cylindrical member F1*a* is configured such that plural ring-shaped members that are sealed to prevent the toners of the respective colors to be replenished to the developing container V from mixing are coupled in the back and forth direction. That is, the fixed cylindrical member F1*a* includes, as examples of a coupling member, a ring-shaped rearward coupling member Lb fixed to the forward surface of the front fixed frame F1, a ring-shaped K color coupling member Lk, a ring-shaped Y color coupling member Ly, a ring-shaped M color coupling member Lm, a ring-shaped C color coupling member Lc, and a forward-wall forward coupling member Lf. The ring-shaped K color coupling member Lk, the ring-shaped Y color coupling member Ly, the ring-shaped M color coupling member Lm, and the ring-shaped C color coupling member Lc are sequentially connected to the forward surface of the ring-shaped rearward coupling member Lb to replenish the corresponding developing containers V with the developers of the respective colors.

In FIGS. 5, 11, and 12, each of the ring-shaped coupling members Lk, Ly, Lm, and Lc for the K, Y, M, and C colors, respectively, has a ring-shaped coupling member body 56. The rearward coupling member Lb to be fixed to the front fixed frame F1 has a thin ring-shaped coupling member body 56'. Further, the forward-wall forward coupling member Lf has a cylindrical portion Lf1.

In FIGS. 10A to 10C, 11, and 12, each of the ring-shaped coupling member bodies 56 has three coupling fixing portions 56*a* on an outer periphery thereof, and each of the ring-shaped coupling member bodies 56' has three coupling fixing portions 56*a'* on an outer periphery thereof. The cylindrical portion Lf1 also has three coupling fixing portions 56*a*". The ring-shaped coupling member bodies 56 and 56' and the cylindrical portion Lf1 are coupled together using three screws N1, and are also fixed to the front fixed frame F1.

Further, a developer supply unit 56*b* is integrally molded with the outer peripheral surface of each of the ring-shaped coupling member bodies 56 for the K, Y, M, and C colors, and a replenishing developer supply opening 56*c* is formed in the inner side of the developer supply unit 56*b*.

A sponge cylindrical transport pipe receiving member 57 as an example of a leakage preventing member is adhered to the upper end surface of the replenishing developer supply opening 56*c*. The transport pipe receiving member 57 is connected to the corresponding one of the toner cartridges TCy, TCm, TCc, and TCk through a replenishing developer transport device (not illustrated), and the developer transported from the corresponding one of the toner cartridges TCy, TCm, TCc, and TCk is supplied to the transport pipe receiving member 57.

In FIGS. 11 and 12, ring-shaped elastic sealing members 58 as examples of a leakage preventing member are attached to both end portions of the inner surface of each of the ring-shaped coupling member bodies 56 in its axial direction.

A ring-shaped spacer 59 as an example of an interval adjustment member is arranged on the inner surface of each of the connection portions between the adjacent ring-shaped coupling member bodies 56 of each of the ring-shaped coupling members Lk, Ly, Lm, and Lc so that the spacer 59 is sandwiched between the sealing members 58.

In FIGS. 5, 11, and 12, the forward-wall forward coupling member Lf has a cylindrical portion Lf1 having substantially the same diameter as each of the ring-shaped coupling member bodies 56, and also has a flat plate portion Lf2 on the forward end surface of the cylindrical portion Lf1. The cylindrical portion Lf1 and the flat plate portion Lf2 are integrally molded.

The head portion of each of the screws N1 projects forward from the coupling fixing portion 56*a*" of the cylindrical portion Lf1. Further, a support hole Lf3 extending in the back and forth direction is formed in a center portion of the flat plate portion Lf2 of the forward-wall ring-shaped coupling member Lf.

In FIGS. 5, 10A, 10B, 11, and 12, a rotational cylindrical member B as an example of a replenishing unit rotation unit is arranged inside the fixed cylindrical member F1*a*. The rotational cylindrical member B includes a rearward cylindrical portion B1 at a rearward end portion thereof, and the rearward end of the rearward cylindrical portion B1 is supported at the front rotation plate PL1. Further, the rearward cylindrical portion B1 is rotatably supported at the front fixed frame F1 through a bearing BR2, and the rotational cylindrical member B is configured to rotate about the rotational shaft GA integrally with the rearward cylindrical portion B1.

A forward through passage Ba as an example of a conducting support portion extending in the back and forth direction along an extension of the rotational shaft GA is formed in a center portion of the rotational cylindrical member B.

The rotational cylindrical member B is configured by sequentially coupling the rearward cylindrical portion B1, a K color cylindrical portion Bk, a Y color cylindrical portion By, an M color cylindrical portion Bm, a C color cylindrical portion Bc, and a forward cylindrical portion Bf in the back and forth direction. The K color cylindrical portion Bk, the Y color cylindrical portion By, the M color cylindrical portion Bm, and the C color cylindrical portion Bc serve to support the leading end portions of the developer replenishing cylinders 14 of the developing containers V of the respective colors.

Each of the cylindrical portions Bk, By, Bm, and Bc has a cylindrical portion body 60. The cylindrical portion body 60 has an outer cylindrical portion 61, and the outer cylindrical portion 61 includes a large diameter outer cylindrical portion 62 on the rearward side and a small diameter outer cylindrical portion 63 on the forward side. The small diameter outer cylindrical portion 63 is formed so as to have an outer diameter that is substantially the same as the inner diameter of the large diameter outer cylindrical portion 62. As illustrated in FIGS. 11 and 12, when the Y color cylindrical portion By is coupled to the other cylindrical portions Bc and Bk in forward and rearward relation, the small diameter outer cylindrical portion 63 fits into the large diameter outer cylindrical portion 62.

A replenishing developer receiving opening 63*a* is formed in a side surface of the small diameter outer cylindrical portion 63. As illustrated in FIGS. 10A and 10E, an inner side bending portion 63*b* and an outer side bending portion 63*c* are formed at both sides in the circumferential direction of the replenishing developer receiving opening 63*a*. The leading end of the inner side bending portion 63*b* bends and extends toward the center of the replenishing developer receiving opening 63*a*. The leading end of the outer side bending portion 63*c* bends and extends outward.

The small diameter outer cylindrical portion 63 including the elements 63*a*, 63*b*, and 63*c*, the replenishing cylinder 14, the rotational shaft 15*a*, the bearing 16, and any other suitable member form the developer replenishing members 14 to 16 and 63 on the rotation side.

In FIGS. 11 and 12, the cylindrical portion body 60 has an inner cylindrical portion 64 in a center portion thereof, and the inner cylindrical portion 64 has a large diameter inner cylindrical portion 66 on the forward side, and a small diameter inner cylindrical portion 67 on the rearward side. The small diameter inner cylindrical portion 67 is formed so as to have an outer diameter that is substantially the same as the inner diameter of the large diameter inner cylindrical portion 66. As illustrated in FIGS. 11 and 12, when the Y color cylindrical portion By is coupled to the other cylindrical portions Bc and Bk in forward and rearward relation, the small diameter inner cylindrical portion 67 fits into the large diameter inner cylindrical portion 66, and the end surfaces of the large diameter inner cylindrical portion 66 of the inner cylindrical portion 64 are brought into contact to determine the positions in back and forth direction.

In FIG. 11, the inner cylindrical portion 64 has at a rearward side portion thereof a through-hole 64*a* extending therethrough in the back and forth direction to form the forward through passage Ba. The inner cylindrical portion 64 also has at a forward side portion thereof an insertion hole 64*b* into which the small diameter inner cylindrical portion 67 is inserted and fits.

In FIGS. 11 and 12, the cylindrical portion body 60 has ring-shaped coupling walls 68 that couple the outer cylindrical portion 61 and the inner cylindrical portion 64 to each other, and four ribs 69 as examples of a strength reinforcement portion. The four ribs 69 are formed in steps of 90° on the forward side surface of the coupling wall 68.

The coupling wall 68 is divided into four wall portions by the four ribs 69, and each of the wall portions has formed therein a through-hole 68*a* of the replenishing cylinder 14. One wall portion has formed therein a bearing through-hole 68*b* as an example of a bearing insertion portion, and the bearing through-hole 68*b* has a smaller inner diameter.

In FIG. 12, the replenishing developer receiving opening 63*a* is formed on the forward side of the bearing through-hole 68*b*, and a bearing receiving hole 68*c* as an example of a bearing receiving unit is formed forward of the replenishing developer receiving opening 63*a*. The bearing receiving hole 68*c* has a diameter that is substantially the same as the inner diameter of the bearing through-hole 68*b*.

In FIG. 12, the replenishing cylinder 14 and the bearing 16 extend through the replenishing cylinder through-hole 68*a* in a rearward-to-forward direction, and the bearing 16 extends through the bearing through-hole 68*b* and is received in the bearing receiving hole 68*c*. In this case, the developer replenishing cylinder 14 is not allowed to extend through the bearing through-hole 68*b*. Thus, the forward end of the developer replenishing cylinder 14 is brought into contact with the coupling wall 68 having the bearing through-hole 68*b* formed therein and is positioned. In this state, as illustrated in FIG. 12, the developer transport inlet 14*a* is arranged so as to correspond to the replenishing developer receiving opening 63*a* between the bearing through-hole 68*b* and the bearing receiving hole 68*c*.

In FIGS. 10A and 10B and 12, a ring cover 70 as an example of a covering member is attached to an outer side surface of the large diameter outer cylindrical portion 62 of the cylindrical portion body 60.

The K color coupling member Lk, the cylindrical portion Bk, the replenishing cylinder 14, and any other suitable member form a K color replenishing unit according to the first exemplary embodiment. Similarly, the Y color coupling member Ly, the cylindrical portion By, the replenishing cylinder 14, and any other suitable member form a Y color replenishing unit. The M color coupling member Lm, the cylindrical portion Bm, the replenishing cylinder 14, and any other suitable member form an M color replenishing unit. The C color coupling member Lc, the cylindrical portion Bc, the replenishing cylinder 14, and any other suitable member form a C color replenishing unit.

Further, the rotational cylindrical member B, the fixed cylindrical member F1*a* and the members arranged therein, and any other suitable member form a replenishing device B+F1*a* according to the first exemplary embodiment.

As may be seen from FIGS. 11 and 12, the ring-shaped coupling members Lk, Ly, Lm, and Lc are sequentially arranged in the back and forth direction from rearward to forward, and the replenishing developer supply openings 56*c* in the ring-shaped coupling members Lk, Ly, Lm, and Lc are arranged at sequentially shifted positions in the back and forth direction.

Then, the replenishing developer receiving openings 63*a* in the cylindrical portions Bk, By, Bm, and Bc arranged on the inner side of the ring-shaped coupling members Lk, Ly, Lm, and Lc, respectively, are arranged at positions shifted 90° about the rotational shaft GA.

Specifically, for example, as illustrated in FIG. 10A, in a state where the replenishing developer receiving opening 63*a* in the cylindrical portion Bk is connected to the replenishing developer supply opening 56*c*, the replenishing developer receiving opening 63*a* in the cylindrical portion Bc is arranged at a position illustrated in FIG. 10B, which is rotated 270° counterclockwise with respect to the position connected to the replenishing developer supply opening 56*c* as illustrated in FIG. 10A. Further, the replenishing developer receiving openings 63*a* in the other cylindrical portions By and Bm are arranged at positions rotated 90° and 180°, respectively, counterclockwise with respect to the positions connected to the replenishing developer supply openings 56*c*.

Then, in FIGS. 10A and 10B, in accordance with clockwise rotation in steps of 90° about the rotational shaft GA, the replenishing developer receiving openings 63*a* in the cylindrical portions By, Bm, and Bc are sequentially moved to the positions connected to the replenishing developer supply openings 56*c*.

In FIGS. 10A and 10B, a developer supplied from the corresponding one of the replenishing developer supply openings 56*c* is replenished to the developer transport inlet 14*a* from the replenishing developer receiving opening 63*a* formed in the side surface of the small diameter outer cylindrical portion 63. The replenishment transport member 15 transports the replenishing cylinder 14 rearward (in the −X direction).

In FIGS. 2, 5, 6A, and 6B, the developer for which the replenishing cylinder 14 has been transported rearward is replenished into the corresponding developing container V from the replenishment connection opening 14*b* and the developer replenishing opening 36.

In FIGS. 5, 11, and 12, the forward side cylindrical portion Bf is arranged on the forward surface of the C color cylindrical portion Bc, and is integrally coupled to the cylindrical portions Bc, Bm, By, and Bk by using four setscrews N2 as examples of a coupling member. The tips of the setscrews N2 are threaded into nuts (not illustrated) fixed to the front rotation plate PL1.

The spaces between the rotating cylindrical portions Bk, By, Bm, and Bc and the fixedly supported ring-shaped coupling members Lk, Ly, Lm, and Lc are sealed by sealing members 58 provided individually for the cylindrical portions Bk, By, Bm, and Bc. Thus, a new two-component developer having carrier and toner, which is replenished to the replenishing developer receiving opening 63*a* from the corresponding replenishing developer supply opening 56*c* is prevented from moving to the other cylindrical portions in the spaces between the cylindrical portions Bk, By, Bm, and Bc and the ring-shaped coupling portions Lk, Ly, Lm, and Lc, respectively.

Description of Density Sensor and Conducting Member

In FIGS. 8A to 8C and 9, the K color developing unit GK according to the first exemplary embodiment includes a toner density sensor SNk as an example of an energized member and also as an example of a detection member so that the toner density sensor SNk is supported on the bottom surface of the container body V1. In FIG. 9, the toner density sensor SNk according to the first exemplary embodiment may be a conventional sensor that detects the ratio of toner to carrier in the developing container V, called a toner density, and may be implemented as, for example, a magnetic toner density sensor that detects a toner density using magnetic permeability which would allow the toner density of even the K color developer to be accurately detected.

Further, in FIGS. 1 to 3, in the copying machine U according to the first exemplary embodiment, a toner density sensor SN1 as an example of a detection member is supported at a position facing the developing roller R0 of one of the developing units GY, GM, GC, and GK that has moved to the second stop position P2. The toner density sensor SN1 may also be a conventional sensor, and may be implemented as, for example, an optical toner density sensor that irradiates the surface of the developing roller R0 with inspection light and that detects the reflected light to detect a toner density. In the first exemplary embodiment, the toner density sensor SN1 arranged at the second stop position P2 measures the toner densities of the Y, M, and C developing units GY, GC, and GM. The toner density of the K developing unit GK is measured by the toner density sensor SNk.

Figure 13:
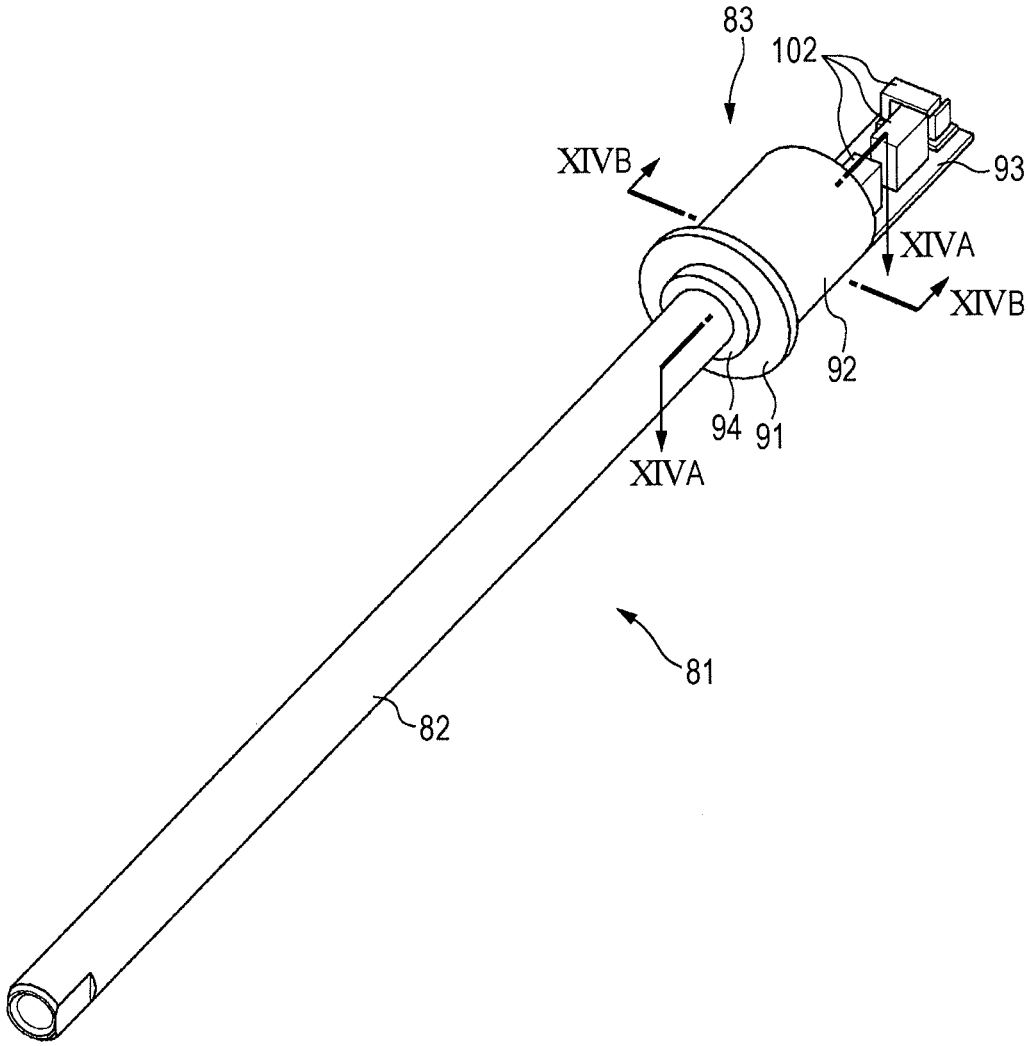
FIG. 13 is a perspective view of a conducting member according to the first exemplary embodiment.

FIG. 13 is a perspective view of a conducting member according to the first exemplary embodiment.

Figure 14A:
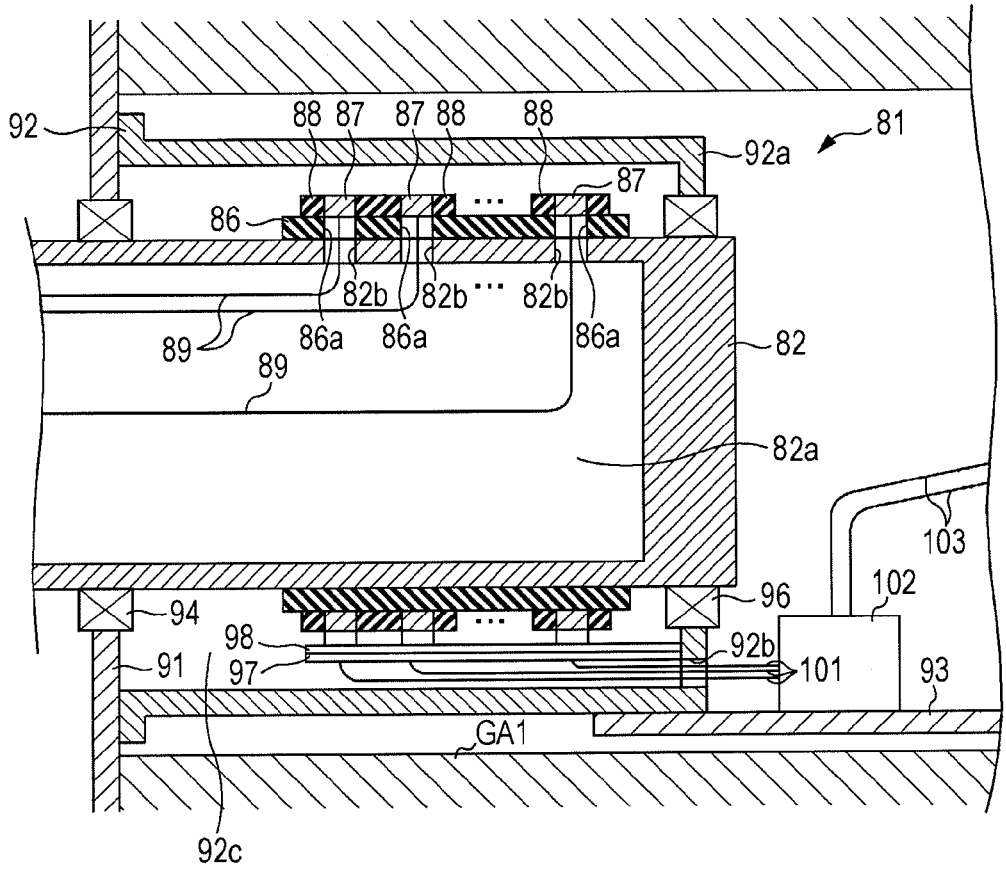
FIGS. 14A and 14B are cross-sectional views of the conducting member according to the first exemplary embodiment, where
Figure 14B:
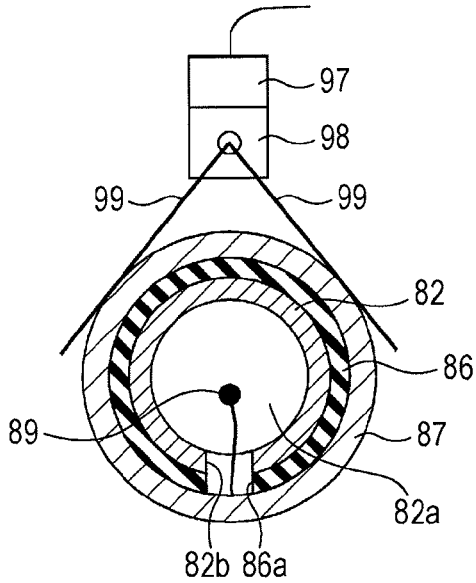

FIGS. 14A and 14B are cross-sectional views of the conducting member according to the first exemplary embodiment. FIG. 14A is a cross-sectional view taken along line XIVA-XIVA of FIG. 13, and FIG. 14B is a cross-sectional view taken along line XIVB-XIVB of FIG. 13.

In FIGS. 5, 9, 10A and 10B, and 11 to 12, a sensor conducting member 81 as an example of a conducting member is supported on an inner portion of the forward through passage Ba and on an inner portion of through passage 1 in the rotational cylindrical member B. In FIGS. 11 to 13 and 14A and 14B, the sensor conducting member 81 according to the first exemplary embodiment includes a fixed pipe 82 as an example of a hollow cylindrical unit, and a rotary unit 83 as an example of a rotatable unit. The fixed pipe 82 is arranged on the forward side and extends in the back and forth direction. The rotary unit 83 is supported rearward of the fixed pipe 82.

The fixed pipe 82 is formed into a cylindrical shape having a space 82*a* therein which extends in the back and forth direction. The outer peripheral surface of the fixed pipe 82 is rotatably supported on the inner peripheral surface of the forward through passage Ba, and the forward end of the fixed pipe 82 is supported in the support hole Lf3. That is, the fixed pipe 82 is supported so as to extend through the forward through passage Ba that is at the center of rotation of the developing device G.

In FIG. 14A, the fixed pipe 82 has at a rearward end thereof plural leading out holes 82*b* extending therethrough in the diameter direction so that the plural leading out holes 82*b* are formed in the axial direction of the fixed pipe 82 at preset intervals. In the first exemplary embodiment, 12 leading out holes 82*b* are formed in the axial direction of the fixed pipe 82 although not all the 12 leading out holes 82*b* are illustrated in FIG. 14A. The number of leading out holes 82*b* is not limited to 12, and may be changed to any number.

A cylindrical insulating cylinder 86 as an example of an insulating member is supported on the outer peripheral surface of the rearward end portion of the fixed pipe 82, and 12 openings 86*a* corresponding to the leading out holes 82*b* are formed in the insulating cylinder 86. Annular, or ring-shaped, conductive rings 87 as examples of a first energizing member are supported on the outer periphery of the insulating cylinder 86. Twelve conductive rings 87 corresponding to the leading out holes 82*b* and the openings 86*a* are arranged in the axial direction, and an insulating ring 88 as an example of an insulating member is held between each pair of conductive rings 87.

One end of a connection cable 89 as an example of a first conductive member is electrically connected to each of the conductive rings 87. The connection cables 89 extend through an inner space 82*a* of the fixed pipe 82 through the openings 86*a* and the leading out holes 82*b*. The connection cables 89 are bundled up in a harness within the inner space 82*a*, and are delivered to outside from the forward end along the fixed pipe 82. The other end of each of the connection cables 89 is connected to the controller C through a connector (not illustrated).

In FIGS. 14A and 14B, the rotary unit 83 includes a disk-shaped forward plate 91 as an example of a forward end member, a cylindrical case 92 as an example of an accommodating member, and a plate-shaped circuit support plate 93 as an example of a circuit support unit. The forward plate 91 is arranged on the forward side of the rotary unit 83. The cylindrical case 92 is supported on a rearward surface of the forward plate 91. The forward end of the circuit support plate 93 is supported by the cylindrical case 92 and extends rearward.

The forward plate 91 is rotatably supported, at a center portion thereof, on the outer peripheral surface of the fixed pipe 82 by using a bearing 94 as an example of a bearing member. The cylindrical case 92 is rotatably supported on the outer peripheral surface at the rearward end of the fixed pipe 82 by using a bearing 96 as an example of a bearing member at a center portion of a rearward end wall 92*a*.

A second leading out opening 92*b* is formed rearward of the rearward end wall 92*a* of the cylindrical case 92 so as to extend through a space between an inner space 92*c* and the circuit support plate 93.

A terminal support portion 97 extending in the back and forth direction is supported on the inner surface of the rearward end wall 92*a* of the cylindrical case 92. Brush support portions 98 as examples of a second energizing member are supported on the terminal support portion 97 so as to correspond to the conductive rings 87. A conductive brush 99 as an example of a contact portion is supported on each of the brush support portions 98. The conductive brushes 99 are in contact with the external surface of the conductive rings 87. In the first exemplary embodiment, each of the conductive brushes 99 is formed of a pair of plate-spring-shaped conductive members arranged so as to hold the corresponding one of the conductive rings 87 therebetween, and is configured such that a portion of the conductive brush 99 that is contacting the outer peripheral surface of the conductive ring 87 is slidable and slides in contact with the outer peripheral surface of the conductive ring 87. One end of each of electrical connection cables 101 as examples of an electrical connection member that are electrically connected to the brush support portions 98 and the conductive brushes 99 is connected to the terminal support portion 97, and the electrical connection cables 101 are led out toward the circuit support plate 93 through the second leading out opening 92*b*.

The circuit support plate 93 has plural IC chips 102 supported thereon as examples of a circuit element, and the other end of the electrical connection cables 101 is connected to the IC chips 102. The IC chips store a preset process program for performing processes such as, in the first exemplary embodiment, feeding electric power to the toner density sensor SNk for the K color developing unit GK, amplifying a control signal, a detection signal, and any other suitable signal, and converting the amplified signals.

One end of each of sensor connecting cables 103 as examples of an electrical connection member is also connected to the IC chips 102. In FIG. 9, the sensor connecting cables 103 are led out to outside the through passage 1 through a cable passage opening 104 as an example of an electrical connection member passage opening. The cable passage opening 104 is formed on a surface facing the K color developing unit GK of the rectangular cylindrical portion GA1, and serves to connect the through passage 1 to an external device. The other end of each of the sensor connecting cables 103 is connected to the toner density sensor SNk of the developing unit GK.

The electrical connection cables 101, the IC chips 102, the sensor connecting cables 103, and any other suitable device form second conductive members 101 to 103 according to the first exemplary embodiment that electrically connect the conductive brushes 99 to the toner density sensor SNk. Further, the members 82 to 103 and any other suitable member form a sensor conducting member 81 according to the first exemplary embodiment.

In the copying machine U according to the first exemplary embodiment, a latent image formed on the surface of the photoconductor PR is developed by each of the developing units GY, GM, GC, and GK that has moved to the developing position P1, and the developers in the developing units GY, GM, GC, and GK are consumed. When the developers in the developing units GY, GM, GC, and GK are consumed, the developing units GY, GM, GC, and GK are replenished with developers from the toner cartridges TCy, TCm, TCc, and TCk in accordance with the amount of consumption.

In this case, if the amount of consumption of a developer, that is, the amount of replenishment of a developer to be replenished, is detected based on only the number of pixels used for the write operation of the latent image forming device ROS, an error may occur and developing defects such as insufficient density or excessive density may occur. In the first exemplary embodiment, therefore, the toner densities of the toners in the developing units GY, GM, GC, and GK are measured by the toner density sensors SN1 and SNk, and the amount of replenishment is corrected.

In the first exemplary embodiment, the toner density sensor SNk is supported in the K color developing unit GK, and the sensor conducting member 81 provides electrical conduction between the toner density sensor SNk and the controller C of the copying machine body U1. That is, the sensor conducting member 81 according to the first exemplary embodiment includes the fixed pipe 82 that is arranged at the center of rotation of the developing device G and that does not rotate, and the rotary unit 83 that is rotatably supported at the fixed pipe 82 through the bearings 94 and 96 and that rotates integrally when the developing device G rotates. The connection cables 89 connected to the controller C extend through the fixed pipe 82 and are connected to the conductive rings 87. In addition, the second conductive members 101 to 103 electrically connected to the toner density sensor SNk of the rotating developing unit GK are connected to the conductive brushes 99. When the developing device G rotates, the conductive brushes 99 slide and rotate in contact with the fixed conductive rings 87 while electrical conduction is maintained.

Therefore, in accordance with the rotation of the developing device G, both ends of each of the connection cables 89 are connected to the controller C and the corresponding one of the conductive rings 87, which are both fixed members, and both ends of the second conductive members 101 to 103 are connected to the conductive brushes 99 and the toner density sensor SNk, which integrally rotate. Thus, the cables 89, 101, and 103 are electrically connected without being twisted.

In the developing device G according to the first exemplary embodiment, furthermore, the fixed pipe 82 extends through the forward through passage Ba up to the forward end thereof, and functions as the rotational axis of the rotational cylindrical member B.

Furthermore, in the first exemplary embodiment, the rotary unit 83 is arranged on the developing units GY, GM, GC, and GK side, and only the fixed pipe 82 extends through the cylindrical portions By, Bm, Bc, and Bk.

In the developing device according to the first exemplary embodiment, additionally, the sensor conducting member 81 is arranged in an extension coaxial with or substantially coaxial with the discharge cylinder 7 and the rotary unit 83 is contained in the through passage 1.

In the first exemplary embodiment, furthermore, the rotational cylindrical member B is provided with the cylindrical portions By, Bm, Bc, and Bk removable from the rearward cylindrical portion B1. Removing the cylindrical portions By, Bm, Bc, and Bk makes the sensor conducting member 81 removable from the developing device G.

Modifications

While an exemplary embodiment of the present invention has been described in detail, the present invention is not limited to the foregoing exemplary embodiment, and a variety of modifications may be made without departing from the scope of the present invention as defined in the appended claims. First to seventh modifications of the present invention will be described hereinafter by way of example.

First Modification

In the foregoing exemplary embodiment, The copying machine U as an example of an image forming apparatus is provided by way of example. However, this is not to be taken in a limiting sense, and a printer, a facsimile machine, a multi-functional machine having such plural functions, or any other suitable machine may be used.

Further, the developing device G having the four developing units GY, GM, GC, and GK is used by way of example. However, this is not to be taken in a limiting sense, and a developing device having plural developing units, for example, more than or less than four developing units, may also be used. That is, the number of stop positions P1 to P4 is not limited to four, and may be more than or less than four.

Second Modification

In the foregoing exemplary embodiment, the fixed pipe 82 may be configured to extend through the rotational cylindrical member B. Alternatively, the length of the fixed pipe 82 may be shorter, and only the connection cables 89 may extend through the forward through passage Ba.

Third Modification

In the foregoing exemplary embodiment, the specific configuration of the developing units GY, GM, GC, and GK, a rotary mechanism for rotation, a mechanism for the transmission of driving behavior, the configuration of a shutter, the specific configuration of a replenishing device, and the like are not limited to those illustrated in the foregoing exemplary embodiment. Any conventional rotary developing device, for example, any configuration disclosed in Japanese Unexamined Patent Application Publication No. 2001-134045, Japanese Unexamined Patent Application Publication No. 2000-231250, Japanese Unexamined Patent Application Publication No. 4-78872, Japanese Unexamined Patent Application Publication No. 2000-122414, Japanese Unexamined Patent Application Publication No. 2000-131942, and Japanese Unexamined Patent Application Publication No. 2000-321858, or any other suitable configuration may be used.

Fourth Modification

In the foregoing exemplary embodiment, the toner density sensor SNk is provided only for the K color, by way of example. This configuration is not to be taken in a limiting sense, and all or some of the Y, M, and C developing units GY, GM, and GC may have a configuration similar to that of the K color developing unit GK. In this case, the sensor connecting cables 103 may be made to extend from the IC chips 102. In the first exemplary embodiment, 12 conductive rings 87 are provided, that is, a 12-channel configuration is used. For example, if only three channels, i.e., electric power feed, signals, and ground connection, are required per toner density sensor, a toner density sensor may be arranged for each of the four developing units GY, GM, GC, and GK, and a single sensor conducting member 81 may handle the toner density sensors.

Fifth Modification

In the foregoing exemplary embodiment, the shape and the number of internal elements of the sensor conducting member 81, the specific shape, and the like may be changed as desired in accordance with the design, specification, or the like. For example, each of the conductive brushes 99 may not necessarily have a plate spring shape, and may be changed as desired. For example, each of the conductive brushes 99 may be formed of a combination of a rigid plate and a spring, or may be formed without using an insulating member.

Sixth Modification

In the foregoing exemplary embodiment, the toner density sensor SNk is provided as an example of an energized member, by way of example. However, this is not to be taken in a limiting sense. For example, a storage medium storing information regarding the developing device G, such as the cumulative number of turns of the developing rollers R0, the so-called customer replaceable unit memory (CRUM), may be provided. In this case, the CRUM may be energized.

Seventh Modification

In the foregoing exemplary embodiment, the fixed pipe 82 may have a cylindrical shape. The fixed pipe 82 may also have a rectangular cylindrical shape, a polygonal cylindrical shape, or any other suitable shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotary developing device configured to rotate about a rotational axis, the rotary developing device comprising:

a plurality of developing units each configured to develop a latent image formed on a surface of an image holding member into a visible image and rotatable about the rotational axis so as to be sequentially movable to a developing position facing the image holding member;

an energized member supported in a developing unit among the developing units;

a hollow cylindrical unit having a space therein, the hollow cylindrical unit being arranged along the rotational axis and fixed so that a rotatable unit rotates about the fixed hollow cylindrical unit;

a first energizing member supported on an outer periphery of the hollow cylindrical unit;

the rotatable unit supported rotatably with respect to the hollow cylindrical unit and rotating together with the rotary developing device;

a second energizing member supported by the rotatable unit, the second energizing member including a contact portion that comes into contact with the first energizing member;

a first conductive member having an end connected to the first energizing member and another end lead out to outside the developing device through the space in the hollow cylindrical unit;

a second conductive member that connects the second energizing member to the energized member; and a replenishing device supported integrally with the developing units so as to be rotatable about the rotational axis, the replenishing device being configured to transport a developer to be replenished to each of the developing units, the replenishing device including a plurality of replenishing units each provided for one of the developing units, the plurality of replenishing units being arranged in an axial direction of the rotational axis, wherein the hollow cylindrical unit is arranged so as to extend through the rotational axis of the replenishing device.

2. The rotary developing device according to claim 1, wherein the contact portion is arranged on an end side of the hollow cylindrical unit in the axial direction, and the end side supports the rotatable unit rotatably with respect to the hollow cylindrical unit.

3. The rotary developing device according to claim 1, wherein the second energizing member includes a plurality of contact portions.

4. The rotary developing device according to claim 1, wherein the first conductive member includes a plurality of electric wires, and the plurality of electric wires is arranged in the space in the hollow cylindrical unit.

5. The rotary developing device according to claim 1, wherein the energized member includes a detection member that detects a density of a developer contained in the developing unit.

6. The rotary developing device according to claim 1, further comprising a transport unit through which a developer discharged from each of the developing units is transported, the transport unit being arranged along the rotational axis and arranged in an extension coaxial with or substantially coaxial with the hollow cylindrical unit.

7. The rotary developing device according to claim 6, wherein each of the developing units is replenished with a new developer and a degraded developer is allowed to be discharged when the developing unit is stopped at the developing position.

8. An image forming apparatus comprising:

an image holding member that rotates;

the rotary developing device according to claim 1, the rotary developing device being configured to develop a latent image formed on a surface of the image holding member into a visible image;

a transfer device that transfers the visible image on the surface of the image holding member onto a medium; and a fixing device that fixes the visible image transferred onto the medium.

9. A rotary developing device configured to rotate about a rotational axis, the rotary developing device comprising:

a plurality of developing units each configured to develop a latent image formed on a surface of an image holding member into a visible image and rotatable about the rotational axis so as to be sequentially movable to a developing position facing the image holding member;

an energized member supported in a developing unit among the developing units;

a hollow cylindrical unit having a space therein, the hollow cylindrical unit being arranged along the rotational axis and fixed so that a rotatable unit rotates about the fixed hollow cylindrical unit;

a first energizing member supported on an outer periphery of the hollow cylindrical unit;

the rotatable unit supported rotatably with respect to the hollow cylindrical unit and rotating together with the rotary developing device;

a second energizing member supported by the rotatable unit, the second energizing member including a contact portion that comes into contact with the first energizing member;

a first conductive member having an end connected to the first energizing member and another end lead out to outside the developing device through the space in the hollow cylindrical unit; and a second conductive member that connects the second energizing member to the energized member, wherein the energized member includes a detection member that detects a density of a developer contained in the developing unit.

10. The rotary developing device according to claim 9, wherein the contact portion is arranged on an end side of the hollow cylindrical unit in the axial direction, and the end side supports the rotatable unit rotatably with respect to the hollow cylindrical unit.

11. The rotary developing device according to claim 9, wherein the second energizing member includes a plurality of contact portions.

12. The rotary developing device according to claim 9, wherein the first conductive member includes a plurality of electric wires, and the plurality of electric wires is arranged in the space in the hollow cylindrical unit.

13. The rotary developing device according to claim 9, further comprising a transport unit through which a developer discharged from each of the developing units is transported, the transport unit being arranged along the rotational axis and arranged in an extension coaxial with or substantially coaxial with the hollow cylindrical unit.

14. An image forming apparatus comprising:

an image holding member that rotates;

the rotary developing device according to claim 9, the rotary developing device being configured to develop a latent image formed on a surface of the image holding member into a visible image;

a transfer device that transfers the visible image on the surface of the image holding member onto a medium; and a fixing device that fixes the visible image transferred onto the medium.

15. A rotary developing device configured to rotate about a rotational axis, the rotary developing device comprising:

a plurality of developing units each configured to develop a latent image formed on a surface of an image holding member into a visible image and rotatable about the rotational axis so as to be sequentially movable to a developing position facing the image holding member;

an energized member supported in a developing unit among the developing units;

a hollow cylindrical unit having a space therein, the hollow cylindrical unit being arranged along the rotational axis and fixed so that a rotatable unit rotates about the fixed hollow cylindrical unit;

a first energizing member supported on an outer periphery of the hollow cylindrical unit;

the rotatable unit supported rotatably with respect to the hollow cylindrical unit and rotating together with the rotary developing device;

a second energizing member supported by the rotatable unit, the second energizing member including a contact portion that comes into contact with the first energizing member;

a first conductive member having an end connected to the first energizing member and another end lead out to outside the developing device through the space in the hollow cylindrical unit;

a second conductive member that connects the second energizing member to the energized member; and a transport unit through which a developer discharged from each of the developing units is transported, the transport unit being arranged along the rotational axis and arranged in an extension coaxial with or substantially coaxial with the hollow cylindrical unit.

16. The rotary developing device according to claim 15, further comprising a replenishing device supported integrally with the developing units so as to be rotatable about the rotational axis, the replenishing device being configured to transport a developer to be replenished to each of the developing units, the replenishing device including a plurality of replenishing units each provided for one of the developing units, the plurality of replenishing units being arranged in an axial direction of the rotational axis, wherein the hollow cylindrical unit is arranged so as to extend through the rotational axis of the replenishing device.

17. The rotary developing device according to claim 16, wherein the contact portion is arranged on an end side of the hollow cylindrical unit in the axial direction, and the end side supports the rotatable unit rotatably with respect to the hollow cylindrical unit.

18. The rotary developing device according to claim 15, wherein the contact portion is arranged on an end side of the hollow cylindrical unit in the axial direction, and the end side supports the rotatable unit rotatably with respect to the hollow cylindrical unit.

19. The rotary developing device according to claim 15, wherein the second energizing member includes a plurality of contact portions.

20. The rotary developing device according to claim 15, wherein the first conductive member includes a plurality of electric wires, and the plurality of electric wires is arranged in the space in the hollow cylindrical unit.

21. The rotary developing device according to claim 15, wherein the energized member includes a detection member that detects a density of a developer contained in the developing unit.

22. An image forming apparatus comprising:

an image holding member that rotates;

the rotary developing device according to claim 15, the rotary developing device being configured to develop a latent image formed on a surface of the image holding member into a visible image;

a transfer device that transfers the visible image on the surface of the image holding member onto a medium; and a fixing device that fixes the visible image transferred onto the medium.

* * * * *